US010427760B2

(12) United States Patent
Ramari

(10) Patent No.: US 10,427,760 B2
(45) Date of Patent: Oct. 1, 2019

(54) AUTOMATIC MOORING DEVICE FOR VESSELS

(71) Applicant: STAEL S.R.L., Villasanta (IT)

(72) Inventor: Luigi Angelo Filippo Ramari, Arcore (IT)

(73) Assignee: STAEL S.R.L., Villasanta (IT)

( * ) Notice: Subject to any disclaimer, the term of this patent is extended or adjusted under 35 U.S.C. 154(b) by 0 days.

(21) Appl. No.: 15/813,466

(22) Filed: Nov. 15, 2017

(65) Prior Publication Data

US 2018/0134347 A1 May 17, 2018

(30) Foreign Application Priority Data

Nov. 16, 2016 (IT) ..... 102016000115543

(51) Int. Cl.

| | |
|---|---|
| ***B63B 22/02*** | (2006.01) |
| ***B63B 21/00*** | (2006.01) |
| ***B63B 21/04*** | (2006.01) |
| ***B63B 21/20*** | (2006.01) |

(52) U.S. Cl.

CPC ..... *B63B 22/02* (2013.01); *B63B 21/00* (2013.01); *B63B 21/04* (2013.01); *B63B 21/20* (2013.01); *B63B 2021/004* (2013.01)

(58) Field of Classification Search

CPC ..... B63B 22/02; B63B 21/00; B63B 21/04; B63B 21/20; B63B 2021/004; B63B 21/60

USPC ..... 114/230.3

See application file for complete search history.

(56) References Cited

U.S. PATENT DOCUMENTS

| | | | | |
|---|---|---|---|---|
| 2,447,945 | A * | 8/1948 | Knowler | B64C 35/005 114/230.3 |
| 2,526,348 | A * | 10/1950 | Gouge | B64C 35/005 114/230.3 |
| 3,193,318 | A | 7/1965 | Guerrant, Jr. | |
| 3,762,757 | A * | 10/1973 | Epstein | B63B 21/60 114/230.3 |
| 3,763,815 | A * | 10/1973 | Hodate | B63B 21/58 114/230.3 |
| 5,123,374 | A * | 6/1992 | McMillan | B63B 21/60 114/230.3 |
| 7,975,638 | B1 | 7/2011 | Harris et al. | |
| 9,051,031 | B1 * | 6/2015 | Dooley | B63B 21/56 |

FOREIGN PATENT DOCUMENTS

| | | |
|---|---|---|
| CN | 102233944 A | 11/2011 |
| DE | 9405401 U1 | 6/1994 |

* cited by examiner

*Primary Examiner* — Anthony D Wiest

(74) *Attorney, Agent, or Firm* — Cantor Colburn LLP

(57) ABSTRACT

An automatic mooring device for vessels includes a coupling element associable with a mooring point or with a vessel, and a capture element, associable with a vessel or with a mooring point and detachably engageable with the coupling element. The coupling element includes an autonomous floating body;

a supporting element fixed to the floating body;

a hook element associated with the supporting element and movable with respect to the supporting element from a coupling position to a release position;

a safety lever, which can engage the hook element so as to close its bend for the retention of the capture element; and elements for retaining the hook element in the coupling position.

19 Claims, 19 Drawing Sheets

AUTOMATIC MOORING DEVICE FOR VESSELS

CROSS-REFERENCE TO RELATED APPLICATIONS

This application is related to and claims the benefit of Italian Patent Application No. 102016000115543, filed on Nov. 16, 2016, the contents of which are herein incorporated by reference in their entirety.

TECHNICAL FIELD

The present disclosure relates to an automatic mooring device for vessels.

BACKGROUND

As is known, every vessel, regardless of its tonnage, that is moored astern to a wharf, requires at least three cables fixed to the land in order to keep it secured correctly: two cables that connect two points of the stern to the wharf and a cable that connects the stem to the sea bed.

The operations for mooring a vessel generally require the intervention of onboard personnel and ground personnel to perform the positioning and tensioning of the mooring cables. These operations, particularly in the presence of wind and waves, are often difficult and onerous and require perfect coordination between the helmsman, the onboard personnel and the ground personnel to conclude the operation in the shortest possible time.

If coordination among the assigned workers is not correct, damage to the vessel, to the wharf, to other vessels and to people is possible.

As is known, in fact, a vessel can be steered only if it is moving. When a vessel is not moving, the rudder is ineffective and the vessel remains in the grasp of the wind and waves. This situation always occurs in the mooring step and in the unmooring step at departure; in these cases, in order to keep the vessel stationary, the engine is not engaged. The direct consequence of this situation is that the vessel is unsteerable. In these conditions, timing is essential in gripping and fixing the mooring cables so as to block the vessel to prevent it from striking the pier and the nearby vessels or, vice versa, from moving away from the mooring place, forcing the helmsman to repeat the maneuver. During mooring operations, good coordination between the helmsman and at least one person of the crew is indispensable in order to secure the vessel with cables at the stern and at the stem, ensuring that a correct distance of the vessel from the pier and from the nearby vessels is maintained.

A similar situation occurs also during unmooring at departure.

The greater the displacement of the vessel, the greater the need becomes for the intervention of auxiliary personnel in order to avoid severe damage in these delicate steps.

In order to simplify and speed up the mooring operations, automatic mooring devices have been proposed which are generally composed of a coupling element which is connected to the vessel or to the mooring point, for example a pier or jetty or wharf, and a capture element which is connected to the mooring point or to the vessel and can be engaged by the coupling element.

These devices have the drawback of requiring significant interventions on the vessel and on the mooring point, which in addition to having substantial costs, modify significantly and permanently the line of the vessel and the appearance of the mooring point.

SUMMARY

The aim of the present disclosure is to solve the problems described above, providing a device that simplifies the mooring operations, reducing the number of workers required, without requiring significant interventions for adaptation of the vessels and/or of the mooring points.

Within this aim, the disclosure provides a device that allows the helmsman to moor the vessel even in the absence of onboard and/or ground personnel.

The disclosure also provides a device that can be used for a wide range of vessels.

The disclosure further provides a device that can be manufactured with modest costs and ensures high reliability in operation.

This aim, as well as these and other advantages which will become better apparent hereinafter, are achieved by providing an automatic mooring device for vessels, comprising a coupling element, associable with a mooring point or with a vessel, and a capture element, associable with a vessel or with a mooring point and detachably engageable with said coupling element, characterized in that said coupling element comprises:

- a floating body;
- a supporting element fixed to said floating body;
- a hook element associated with said supporting element and movable with respect to said supporting element from a coupling position, in which it is adapted to couple and retain in its bend said capture element due to a relative motion between said hook element and said capture element along a direction that is substantially parallel to the direction of motion of the vessel, to a release position, in which it is adapted to release said capture element coupled previously and vice versa;
- a safety lever, which can engage said hook element so as to close its bend for the retention of said capture element once it has been coupled;
- means for retaining said hook element in said coupling position which can be deactivated on command in order to allow the transition of said hook element from said coupling position to said release position.

BRIEF DESCRIPTION OF THE DRAWINGS

Further characteristics and advantages of the disclosure will become better apparent from the description of a preferred but not exclusive embodiment of the device according to the disclosure, illustrated by way of nonlimiting example in the accompanying drawings, wherein.

DETAILED DESCRIPTION OF THE DRAWINGS

Figure 1:
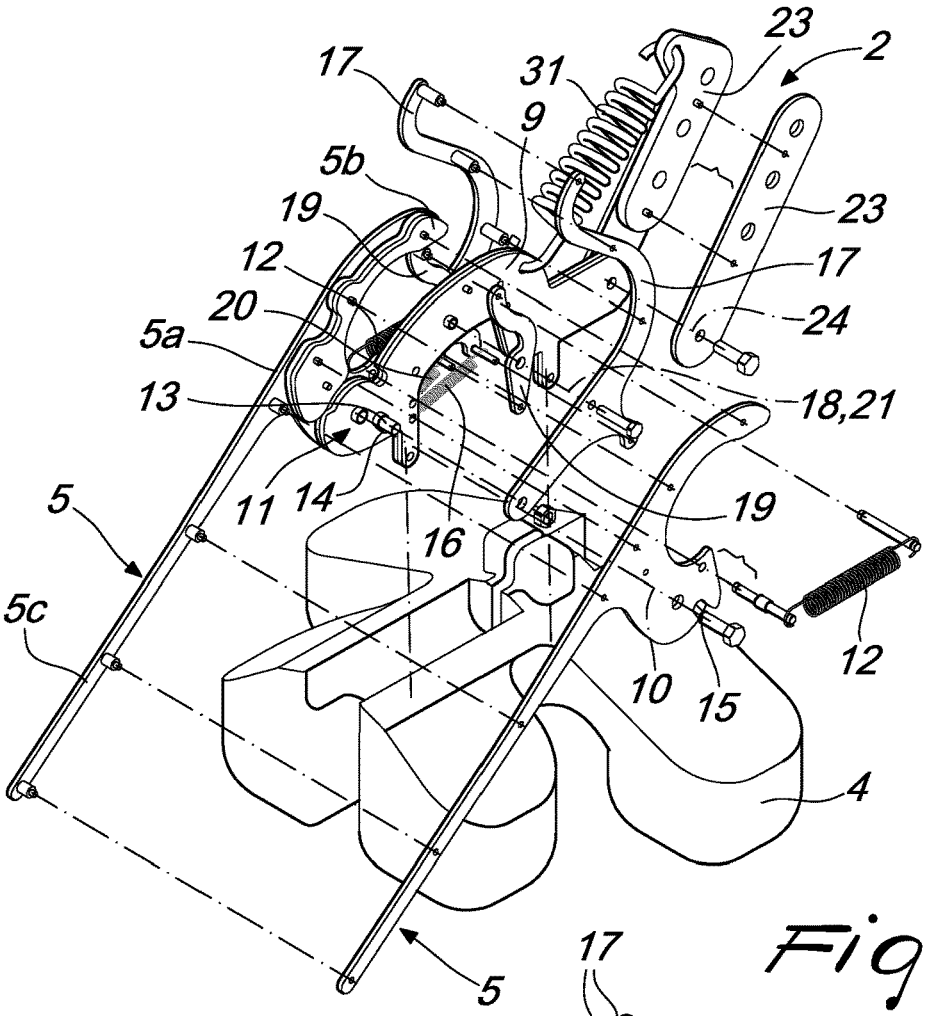
FIG. 1 is an exploded perspective view of the coupling element, with some components omitted.
Figure 2:
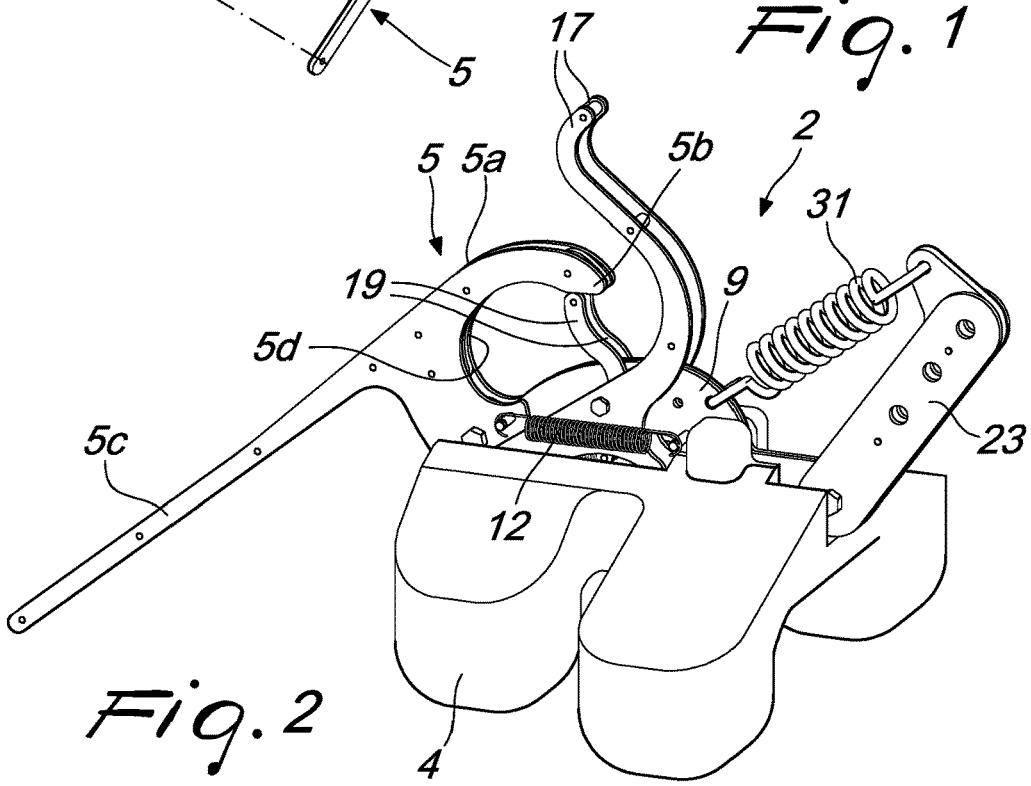
FIG. 2 is a perspective view of the assembled coupling element, with some components omitted.
Figure 3:
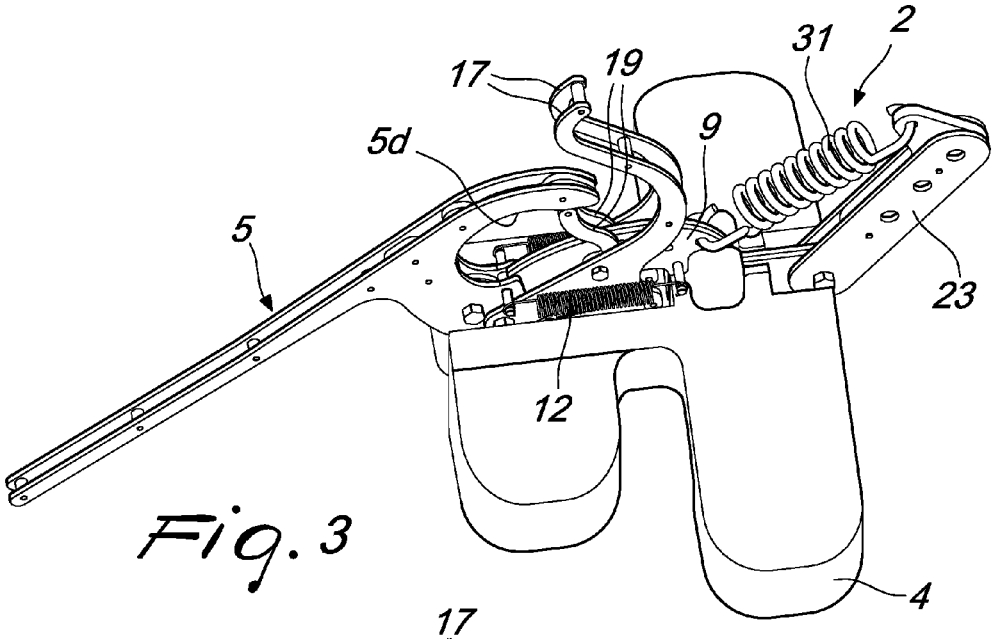
FIG. 3 is a perspective view of the assembled coupling element, with some components omitted, taken from a different angle with respect to FIG. 2.
Figure 4:
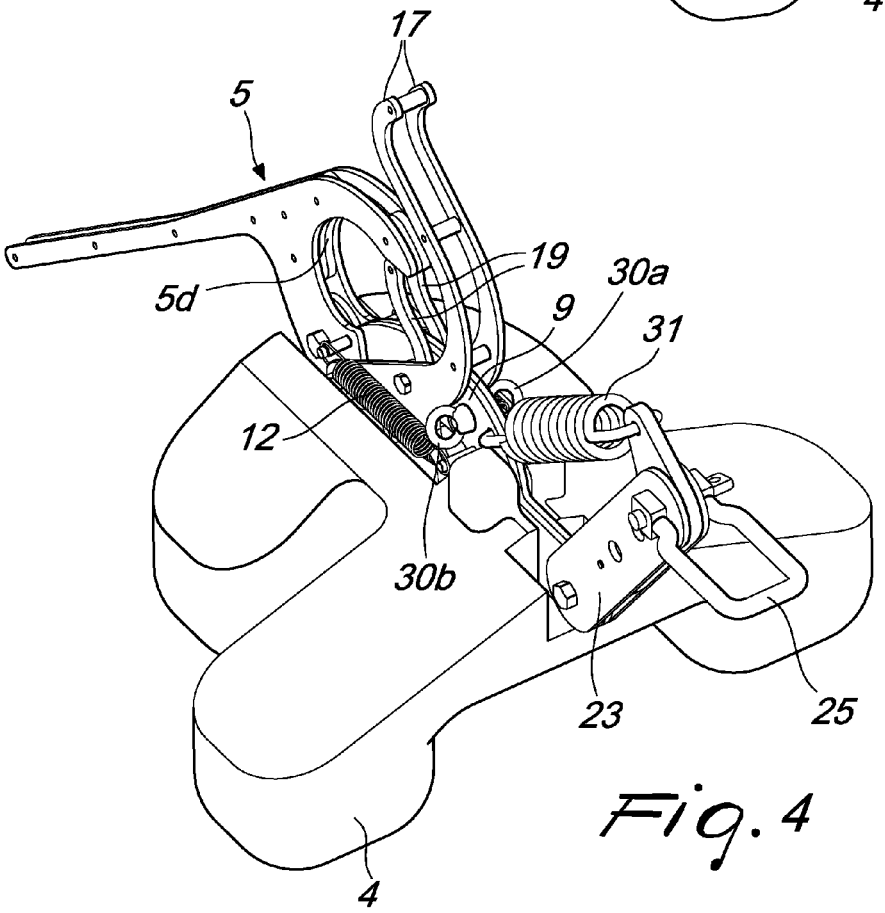
FIG. 4 is a perspective view of the assembled coupling element, taken from a different angle with respect to FIGS. 2 and 3.
Figure 5:
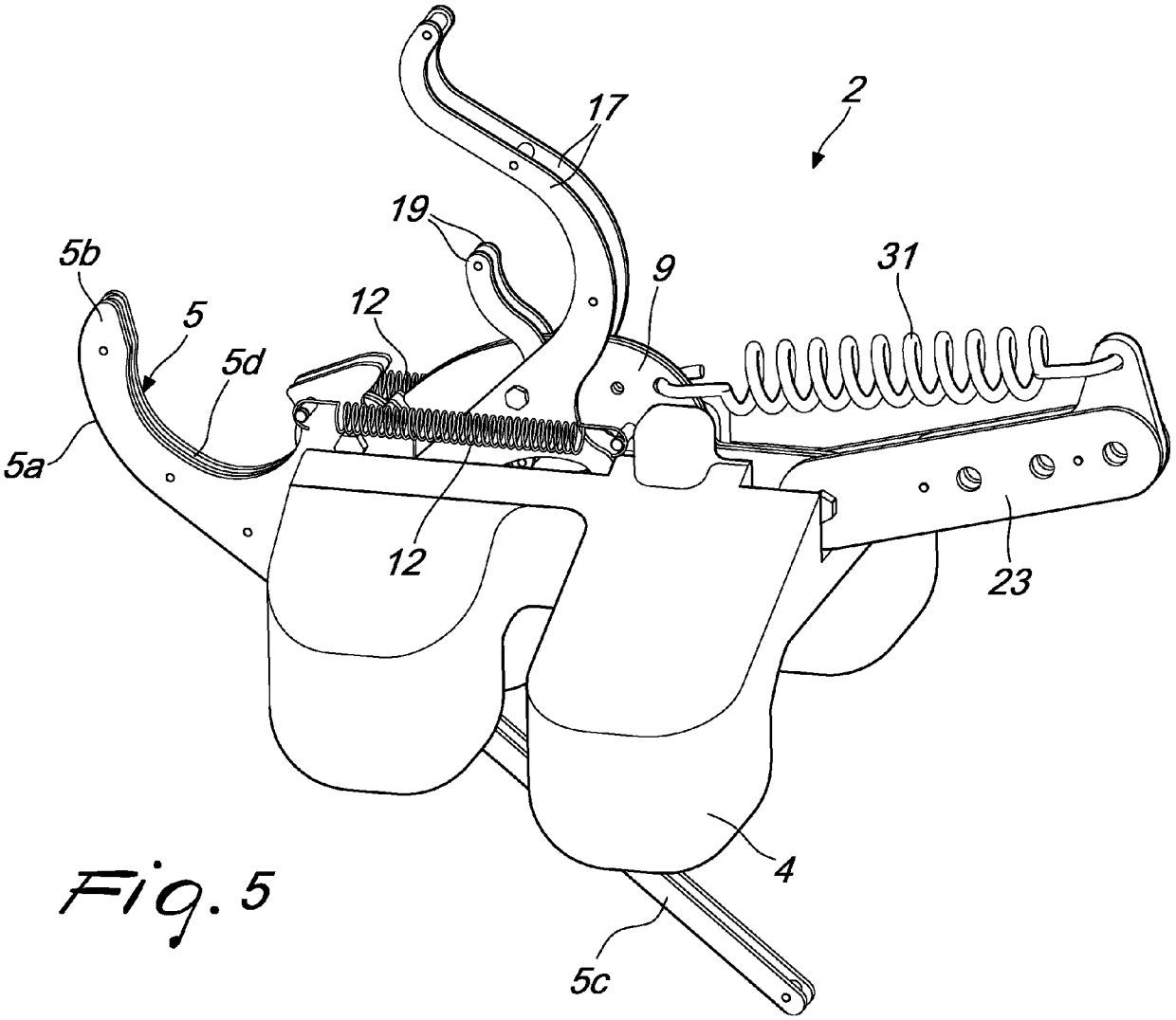
FIG. 5 is a perspective view of the coupling element, with some components omitted, in a different operating condition with respect to the one of FIGS. 1 to 4.
Figure 6:
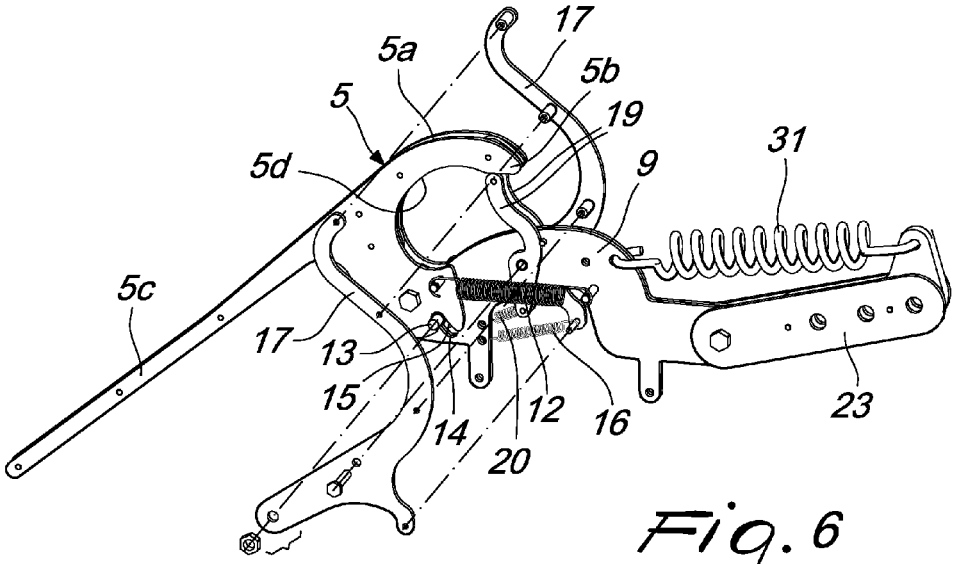
FIGS. 6 and 7 are partially exploded perspective views of some components of the coupling element in the transition from the operating condition shown in FIGS. 1 to 4 to the operating condition shown in FIG. 5.

With reference to FIGS. 1-16, the device according to the disclosure, designated generally by the reference numeral 1, comprises a coupling element 2, which can be associated with a mooring point, such as for example a pier or jetty or wharf 40 or a buoy 41, or with a vessel 42 and a capture element 3 which vice versa can be associated with a vessel 42 or with a mooring point 40, 41 and which can be engaged detachably with the coupling element 2.

According to the disclosure, the coupling element 2 comprises an autonomous floating body 4 to which a supporting element 9 is fixed which supports a hook element 5, which can move with respect to the supporting element 9 from a coupling position, shown in FIGS. 2, 3, 4, 10, 10*a*, 11, 11*a*, 12, 12*a*, 13, 13*a*, 15, 15*a*, 16, in which it is adapted to couple and retain, in its bend 5*d*, the capture element 3 due to a relative motion between the hook element 5 and the capture element 3 along a direction that is substantially parallel to the direction of motion 8 of the vessel 42, to a release position, shown in FIGS. 5, 7, 14, 14*a*, in which it is adapted to release the capture element 3, and vice versa. Furthermore, the coupling element 2 comprises a safety lever 19, which can engage the hook element 5 to close its bend 5*d* in order to retain the capture element 3 once it has been coupled, and means 11 for retaining the hook element 5 in the coupling position; these retention means 11 can be deactivated on command in order to allow the transition of the hook element 5 from the coupling position to the release position.

The term "autonomous", referred to the floating body 4, is intended to mean that the floating body 4 is distinct from the vessel 42 or from the buoy 41 or pier, jetty or wharf 40 with which the floating body 4 is designed to be associated in the manners that will be described better in detail hereinafter.

In the illustrated embodiment, the capture element 3 comprises a cable 6 and means 7 for tensioning a portion 6*a* of said cable 6 transversely to the direction of motion 8 of the vessel 42 to be moored. The cable portion 6*a* can engage the hook element 5 as an effect of a relative motion between the hook element 5 and the cable portion 6*a* along a direction that is substantially parallel to the direction of motion 8 of the vessel 42.

As an alternative, the capture element 3 can be constituted by a bar which is arranged transversely to the direction of motion 8 of the vessel 42 to be moored. Said bar, together with the cable portion 6*a*, can engage the hook element 5 as an effect of a relative motion between the hook element 5 and said bar along a direction that is substantially parallel to the direction of motion 8 of the vessel 42. It is preferable for this bar to be associated with the vessel 42 so as to not require permanent interventions on the mooring point, which is generally designed to serve multiple users; however, it might also be fixed to the mooring point, if it is constituted by a pier, jetty or wharf 40 or by a pair of buoys 41.

For the sake of simplicity in description, the embodiment shown is described hereinafter, in which the capture element 3 is constituted by the cable 6 and by the tensioning means 7 of the cable portion 6*a*, it being understood that what is mentioned for the cable portion 6*a* can be applied to the bar, in the alternative version of the capture element 3 mentioned, or to another possible embodiment of the capture element 3 that can engage the hook element 5.

Conveniently, the coupling element 2 has a sliding ramp which is adapted to guide the cable portion 6*a*, or more generally the capture element 3, toward the opening of the bend 5*d* of the hook element 5 during the relative approach motion of the cable portion 6*a*, or more generally of the capture element 3, to the coupling element 2.

In greater detail, the floating body 4 of the coupling element 2 can be constituted by a body made of molded synthetic material that can resist for a long time immersed in water and exposed to atmospheric agents.

The supporting element 9 is constituted preferably by a plate-like body which is fixed stably to the floating body 4 and supports the hook element 5.

More particularly, the hook element 5, in the condition for use, i.e., with the floating body 4 in the water, is arranged on a substantially vertical plane and is pivoted to the supporting element 9 with an intermediate portion thereof about a first axis 10 which is substantially horizontal and perpendicular to the plane of arrangement of the hook element 5. The hook element 5 can rotate with respect to the supporting element 9 about the first axis 10 in order to pass from the coupling position, in which it is preferably arranged with its tip 5*b* directed oppositely with respect to the direction of approach of the cable portion 6*a*, or more generally of the capture element 3, to be engaged and with its back 5*a* directed toward the cable portion 6*a*, or more generally toward the capture element 3, during the approach of the vessel 42 to the mooring point 40, 41, to the release position, in which it is preferably arranged with its tip 5*b* directed upward or directed oppositely with respect to the coupling position in order to release the cable portion 6*a* or more generally the capture element 3 engaged previously and vice versa.

Furthermore, the hook element 5 can move from the coupling position to the release position by virtue of the action of the cable portion 6*a*, or more generally of the capture element 3, in contrast with the action of first elastic means 12.

Figure 7:
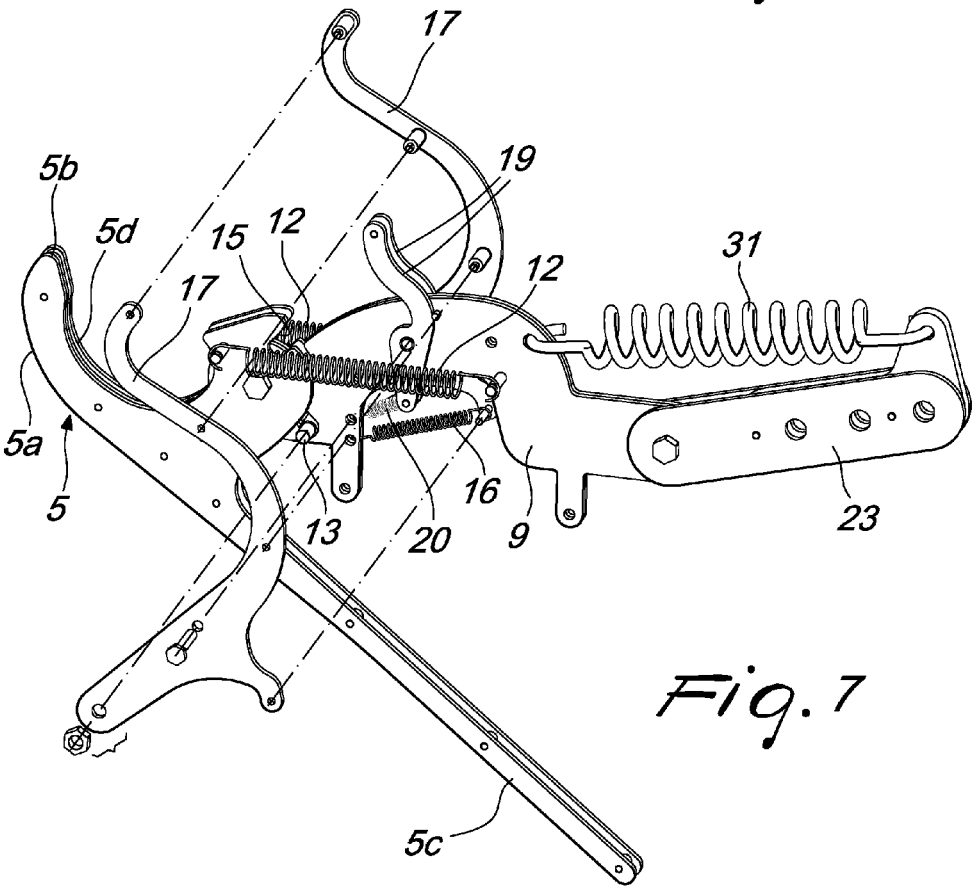
Figure 8:
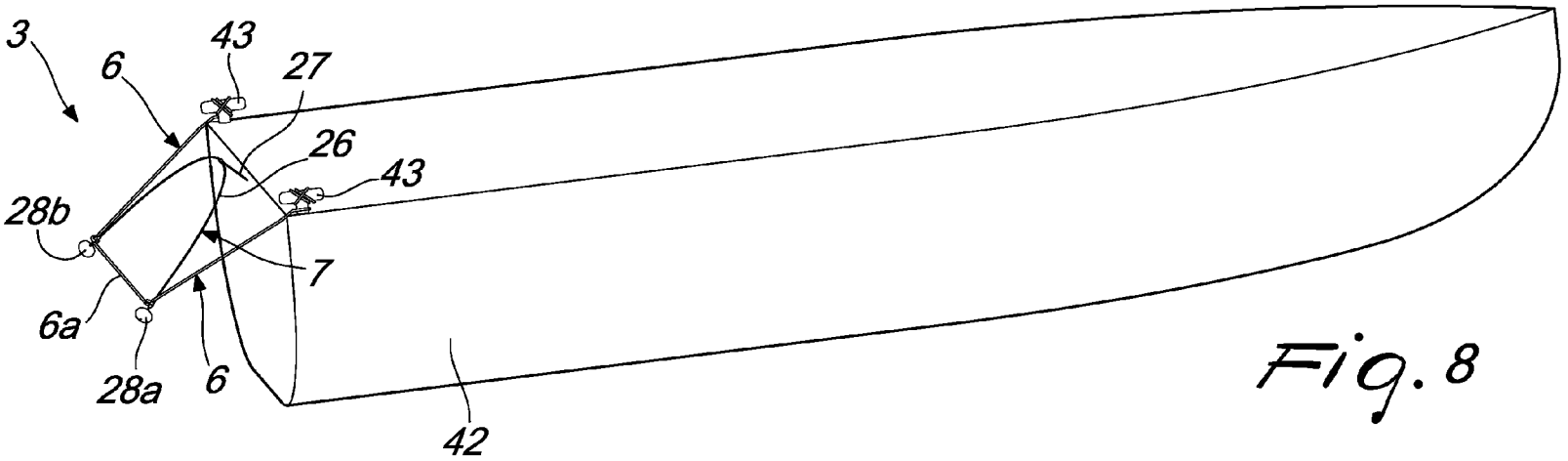
FIG. 8 is a schematic perspective view of a vessel with the capture element mounted astern, with the water omitted for the sake of greater clarity.
Figure 8A:
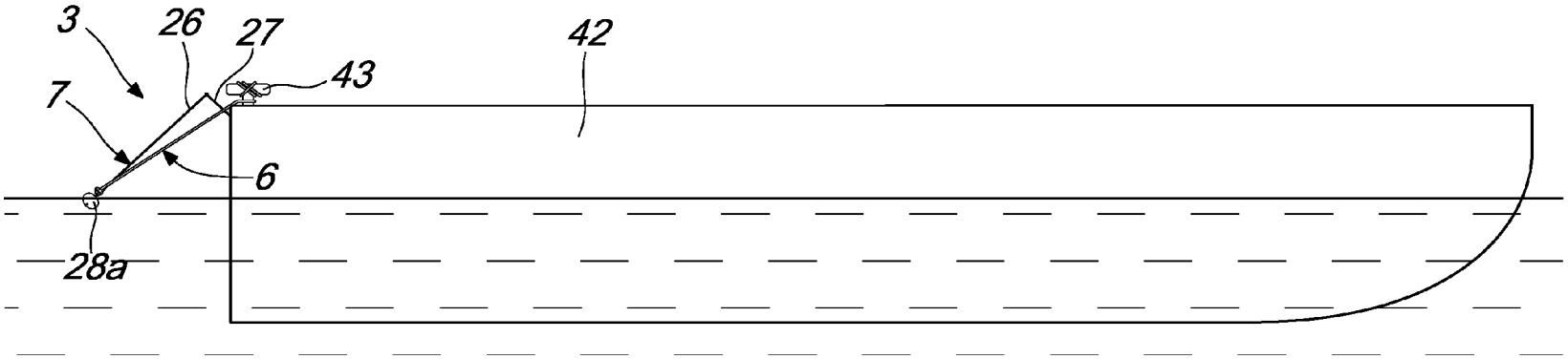
FIG. 8*a* is a schematic lateral elevation view of the vessel of FIG. 8.
Figure 9:
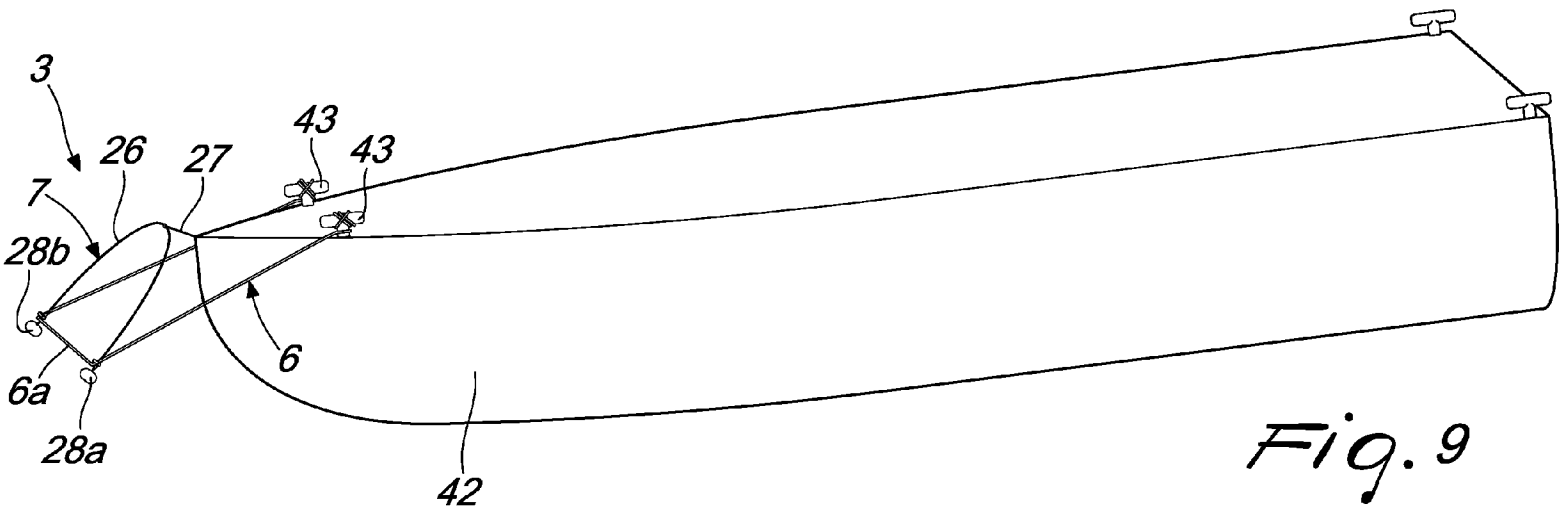
FIG. 9 is a schematic perspective view of a vessel with the capture element mounted on the bow, with the water omitted for the sake of greater clarity.
Figure 9A:
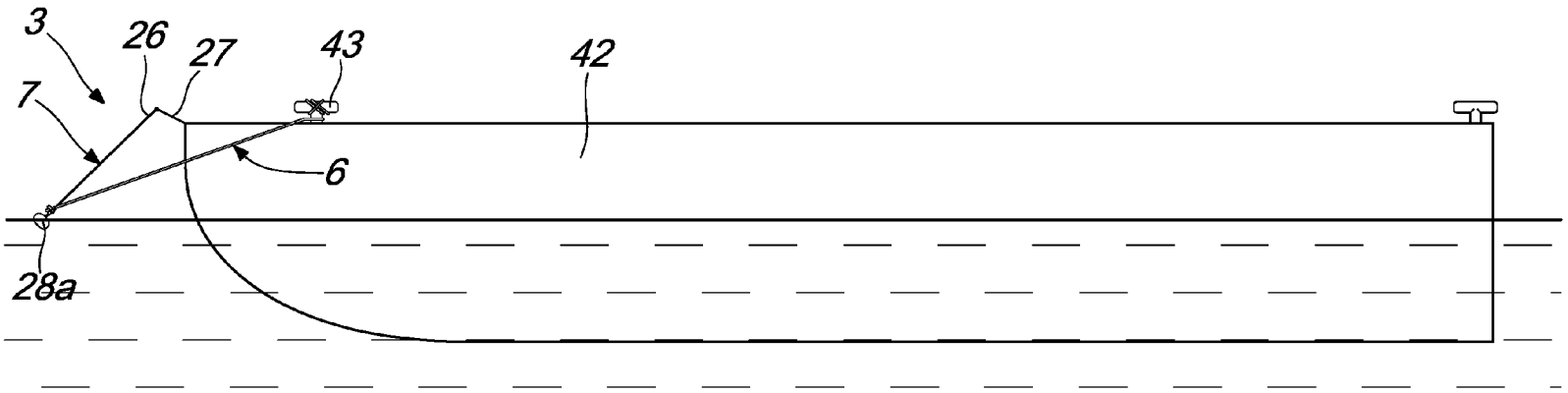
FIG. 9*a* is a schematic lateral elevation view of the vessel of FIG. 9.

In greater detail, the means 11 for retaining the hook element 5 in the coupling position comprise a locking element 13, constituted for example by a finger, which is guided within a slot 14 formed in the supporting element 9 and can move from an activated position, shown in particular in FIG. 1, in which it engages a seat 15 formed in the profile of the hook element 5 and is positioned at the slot 14 when the hook element 5 is in the coupling position, so as to prevent the rotation of the hook element 5 about the first axis 10, to a deactivated position, shown in FIG. 7, in which it is disengaged from the seat 15 so as to allow the rotation of the hook element 5 about the first axis 10 with respect to the supporting element 9 in order to allow the transition of the hook element 5 from the coupling position to the release position, as shown in particular in FIG. 7. The rotation of the hook element 5 in the transition from the coupling position to the release position is contrasted by the first elastic means 12, constituted by a pair of springs that connect a portion of the hook element 5 to the supporting element 9.

The transition of the locking element 13 from the activated position to the deactivated position also is contrasted by second elastic means 16, which in the absence of other forces that act on the locking element 13 maintain or return automatically said locking element 13 in or to the activated position.

The finger, which constitutes the locking element 13, is fixed to a locking lever 17, which is pivoted, with an intermediate portion thereof, to the supporting element 9 about a second axis 18 which is parallel to the first axis 10. The locking lever 17 can rotate with respect to the supporting element 9 about said second axis 18 in contrast with, or by virtue of the action of the second elastic means 16, constituted by a spring which connects a portion of to the locking lever 17 to the supporting element 9.

The finger, which constitutes the locking element 13, is arranged proximate to one end of the locking lever 17, while the other end of the locking lever 17, which is conveniently hook-shaped, protrudes upward from the supporting element 9. It is possible to act on this end of the locking lever 17 to cause the rotation of the locking lever 17 with respect to the supporting element 9 about the second axis 18 in order to cause the transition of the locking element 13, constituted by the finger, from the activated position to the deactivated position in contrast with the action applied by the spring 16.

The hook element 5, as well as the locking lever 17, are constituted by a pair of twin parts, preferably made of sheared steel plate, which are fixed to each other and are arranged on mutually opposite sides with respect to the supporting element 9 to which they are pivoted.

The hook element 5 has a curved back 5*a*, which ends, on one side, with the tip 5*b* of said hook element 5 and which, on the opposite side, is provided appropriately with a tab 5*c* which extends the back 5*a* oppositely with respect to the tip 5*b*. Said tab 5*c* forms, for the cable portion 6*a* or more generally for the capture element 3, the above cited sliding ramp, which guides the cable portion 6*a* or the capture element 3 in the direction of the tip 5*b*, i.e., toward the opening of the bend 5*d* of the hook element 5, during the motion of approach of the cable portion 6*a*, or more generally of the capture element 3, with respect to the hook element 5 or of the hook element 5 with respect to the cable portion 6*a* or capture element 3, depending on whether the coupling element 2 is secured to the mooring point 40, 41 or to the vessel 42.

The safety lever 19 can be disengaged from the tip 5*b* of the hook element 5 by virtue of the action of the cable portion 6*a* or more generally of the capture element 3 when it passes from the back 5*a* of the hook element 5 to the inside of the bend 5*d* of the hook element 5 and the movement for disengagement of the safety lever 19 from the tip 5*b* of the hook element 5 is contrasted by third elastic means 20.

More particularly, the safety lever 19 is pivoted to the supporting element 9 about a corresponding third axis 21, which is parallel to the first axis 10, and can rotate with respect to the supporting element 9 about said third axis 21 so as to pass from a closed position, in which it is engaged with the tip 5*b* of the hook element 5, to an open position, in which it is disengaged from the tip 5*b* of the hook element 5, in contrast with the action of the third elastic means 20, which are constituted by a spring which connects a portion of the safety lever 19 to a portion of the supporting element 9.

In the illustrated embodiment, the third axis 21 coincides with the second axis 18, since the pivoting of the safety lever 19 is performed by means of the same pivot that is used for the pivoting of the locking lever 17 to the supporting element 9.

The safety lever 19 also can be constituted by a pair of twin parts, preferably made of sheared steel plate, which are fixed to each other and are arranged on mutually opposite sides with respect to the supporting element 9.

The hook element 5 is designed to be oriented with its back 5*a* directed in the direction of the cable portion 6*a*, or more generally of the capture element 3, which it must engage and preferably there are means 22 for orienting the hook element 5 in order to keep the back 5*a* of the hook element 5, in the coupling position, oriented toward the cable portion 6*a*, or capture element 3, during the approach of the vessel 42 to the mooring point 40, 41.

In greater detail, proximate to one end of the supporting element 9 the end of an anchoring lever 23 is pivoted about a corresponding fourth axis 24, which also is parallel to the first axis 10, and has, at the opposite end, a shackle 25 which can be used to secure the coupling element 2 to the mooring point 40, 41 or to the vessel 42. The connection of the anchoring lever 23 to the mooring point, if the latter is constituted by a pier or jetty or wharf 40, can be performed simply by means of a cable or chain 45 which is inserted in the ring of the shackle 25 and is fixed to the pier or jetty or wharf 40 by utilizing a pair of bitts or rings 44 that are already present on the pier or jetty or wharf 40. In this case, the correct orientation of the hook element 5, on a vertical plane that is perpendicular to the mooring side of the pier or jetty or wharf, with the back 5a in a position suitable to receive the cable portion 6*a*, or more generally the capture element 3, associated with the vessel 42, can be obtained by means of a pair of cables or chains 29*a*, 29*b*, which couple, on mutually opposite sides, the supporting element 9 directly to the pier or jetty or wharf 40 or to the cable or chain 45. For the connection of the pair of cables or chains 29*a*, 29*b* to the supporting element 9 it is possible to provide two eyebolts 30*a*, 30*b* on the two opposite sides of the supporting element 9.

If the coupling element 2 must be secured to a buoy 41, it is possible to use directly the ring of the shackle 25, as shown in FIGS. 10 to 14, and the correct orientation of the hook element 5 with respect to the cable portion 6*a* connected to the vessel 42 is obtained automatically by virtue of the action of the wind and of the current, since the approach of a vessel 42 to the buoy 41 for mooring is usually performed against the wind and against the current.

The tensioning means 7 of the cable portion 6*a* comprise a bow 26 which is elastic, i.e., elastically flexible, can be secured to the vessel 42 or to the mooring point 40, 41 and can engage the ends of the cable portion 6*a*. More particularly, the elastic bow 26 can be coupled to the vessel 42 or the mooring point 40, 41 by means of a rod 27 which supports the elastic bow 26 in an intermediate region of its extension and is fixed to the vessel 42 or to the mooring point 40, 41. The fixing of the rod 27 to the vessel 42 or to the mooring point 40, 41 can be performed in a simple manner by means of hooks and-loop strips, for example of the type known commercially by the trademark "Velcro®". Conveniently, the elastic bow 26 is provided, at its ends, with floats 28*a*, 28*b* which keep the cable portion 6*a* at a preset height level, with respect to the free surface of the water, which is correlated to the height level, with respect to the free surface of the water, of the tab 5*c* of the hook element 5. The cable 6, subtended by the elastic bow 26, is fixed, by means of its end portions, arranged externally to the cable portion 6*a* tensioned by the elastic bow 26, to the vessel 42 or to the mooring point 40, 41. For the fixing of the cable 6 it is possible to use anchoring points, such as for example rings 44 that are already present in the mooring point 40, 41, if the capture element 3 is designed to be connected to the mooring point 40, 41, or the bills 43 arranged ahead or astern of the vessel 42, if the capture element 3 is designed to be connected to the vessel 42.

Preferably, the anchoring lever 23 can rotate with respect to the supporting element 9 about the fourth axis 24 in contrast with, or by virtue of the action of, fourth elastic means 31, which are constituted by a spring which connects a portion of the anchoring lever 23 to the supporting element 9 and has the function of damping the stresses to which the coupling element 2 is subjected during mooring either due to the wind and the wave motion so as to not overstress the cable 6 or more generally the capture element 3.

Figure 16:
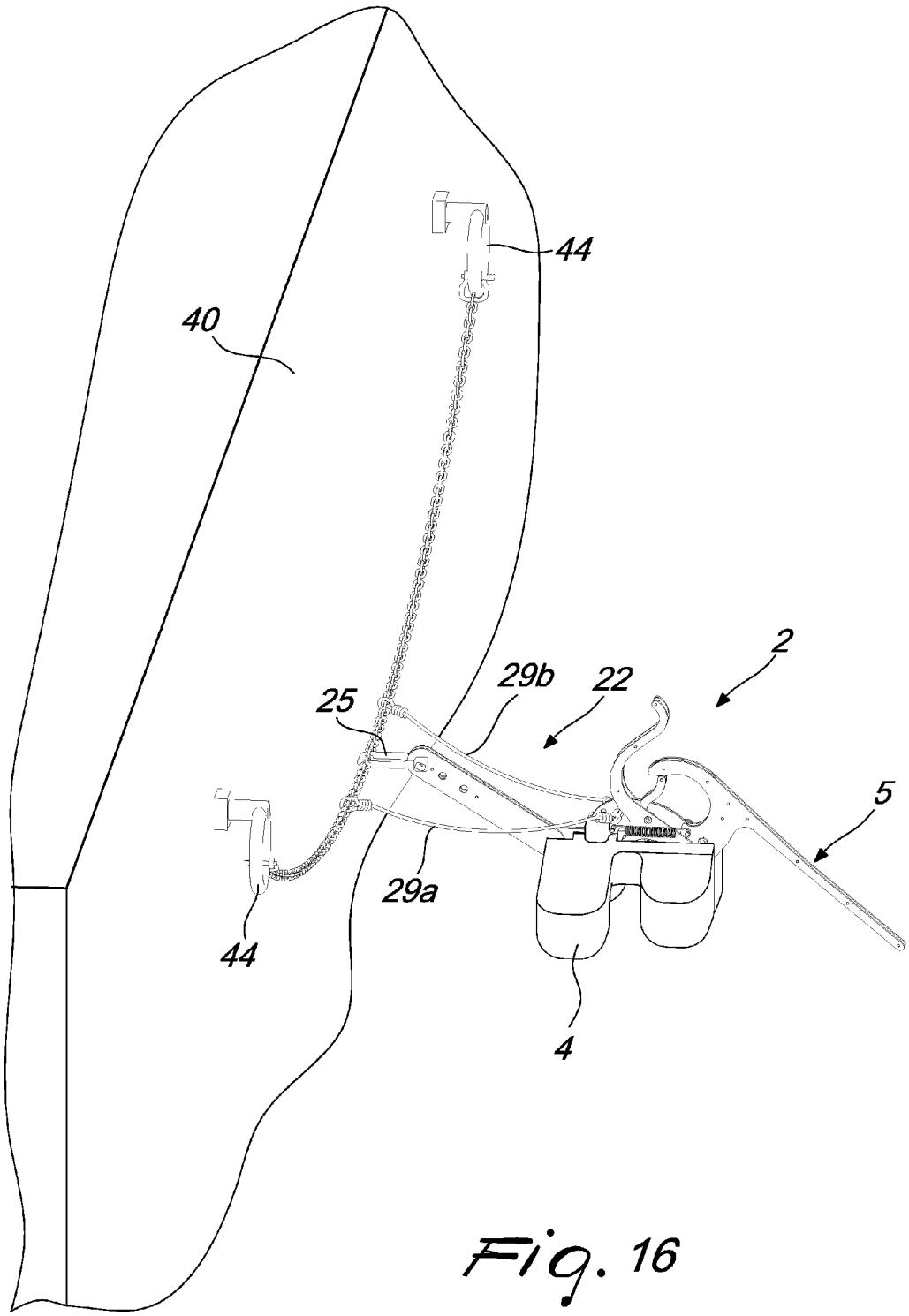
FIG. 16 is a perspective view of a different method of securing the coupling element to a wharf or jetty or pier, with the water omitted for the sake of greater clarity.

As an alternative, if the coupling element 2 is designed to be secured to a pier, jetty or wharf 40, the spring that constitutes the fourth elastic means 31 can be omitted, as shown in FIG. 16, so that the possibility of the anchoring lever 23 to rotate with respect to the supporting element 9 allows the coupling element 2 to follow the level variations caused by tides.

It should be noted that the articulation that exists between the anchoring lever 23 and the supporting element 9 is also useful for the positioning of the coupling element 2 when the connecting point is particularly close to the water and ensures the necessary rigidity in order to maintain the correct position together with the cables 29*a* and 29*b*.

The use of the automatic mooring device according to the disclosure is now described assuming, as shown in FIGS. 10 to 14, that the coupling element 2 is connected to a mooring point, such as for example a pier or jetty or wharf 40 or a buoy 41, and that the cable portion 6*a* is connected to a vessel 42.

During the approach of the vessel 42 to the mooring point 40, 41, the cable portion 6*a* is tensioned by the elastic bow 26 and is retained, as consequence of the presence of the floats 28*a*, 28*b*, substantially at the level of the surface of the water or slightly above it.

Figure 10:
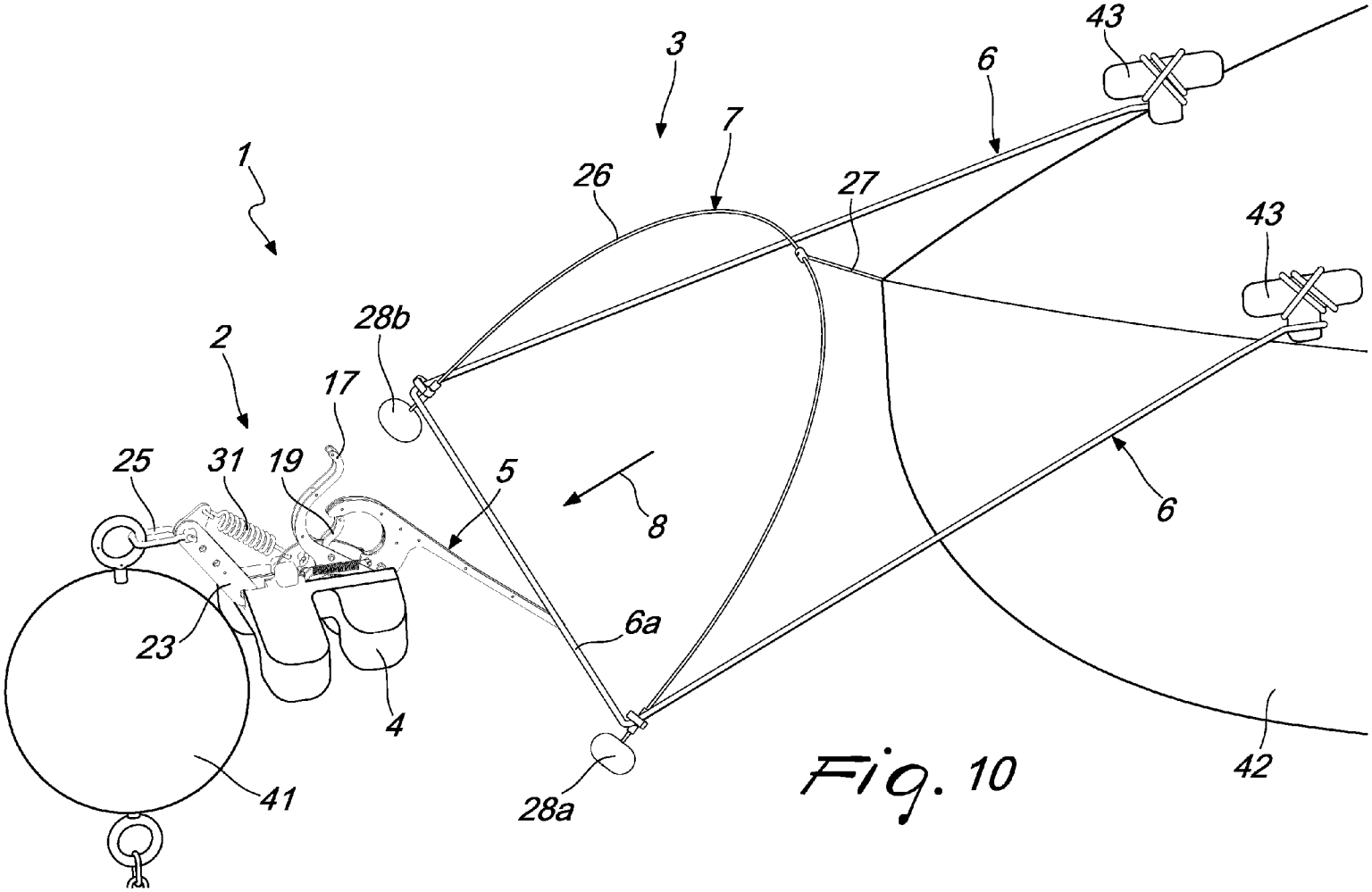
FIG. 10 is a perspective view of the vessel of FIG. 9 during approach to the coupling element that is secured to a buoy, with the water omitted for the sake of greater clarity.
Figure 10A:
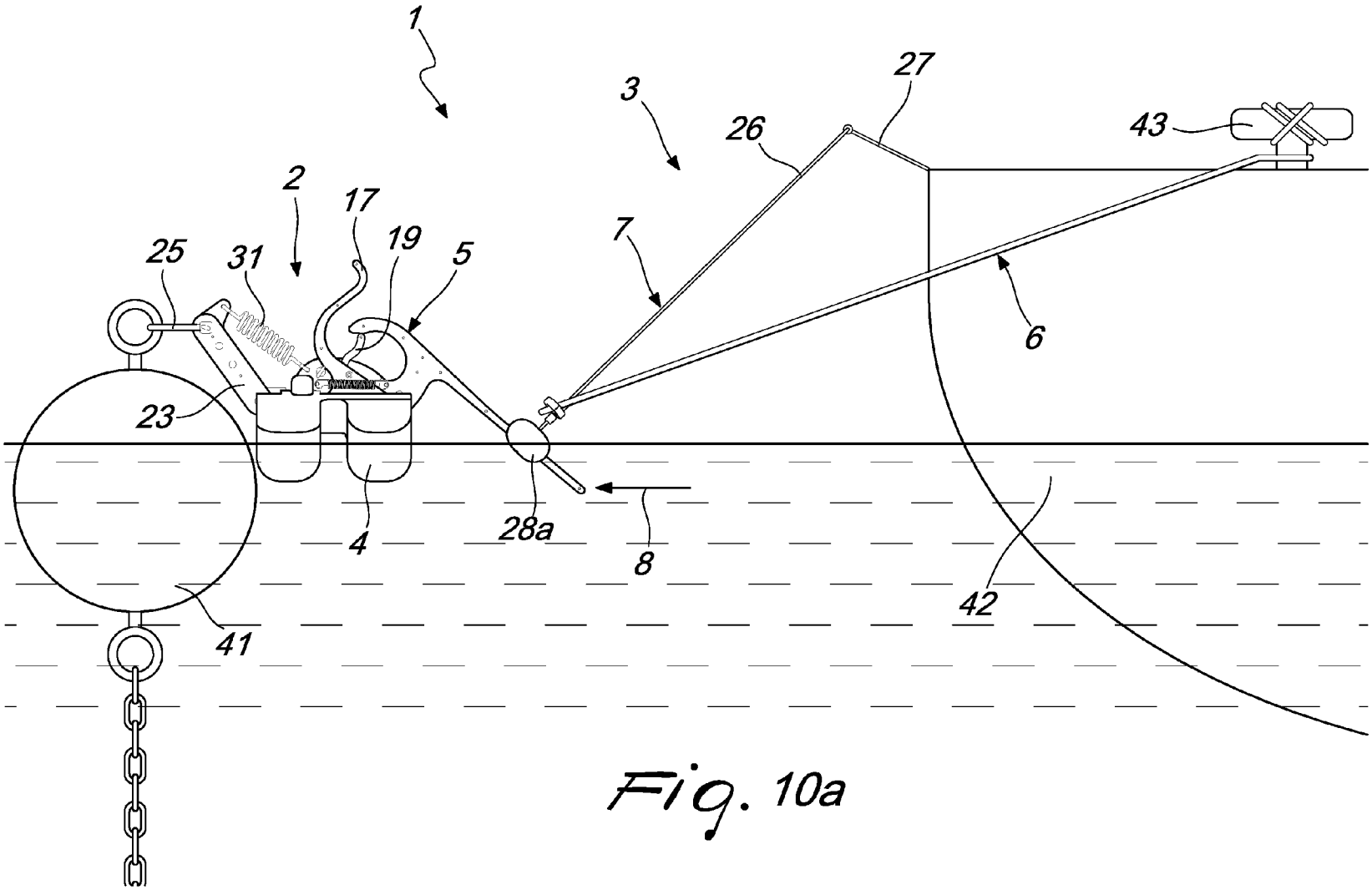
FIG. 10*a* is a lateral elevation view of the same situation of FIG. 10.
Figure 11:
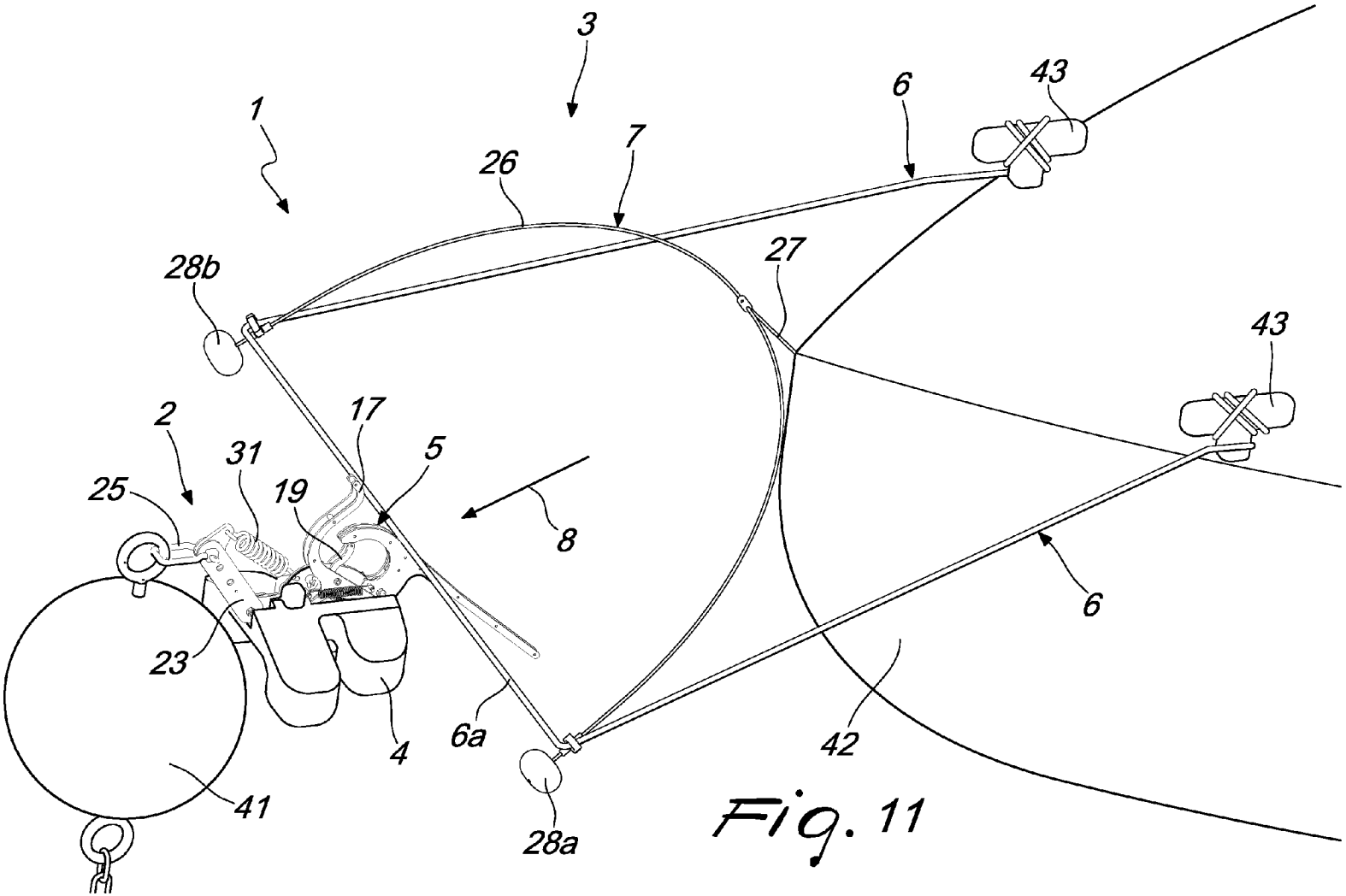
FIG. 11 is a perspective view of the vessel of FIG. 9 during the beginning of the engagement of the capture element with the coupling element secured to a buoy, with the water omitted for the sake of greater clarity.
Figure 11A:
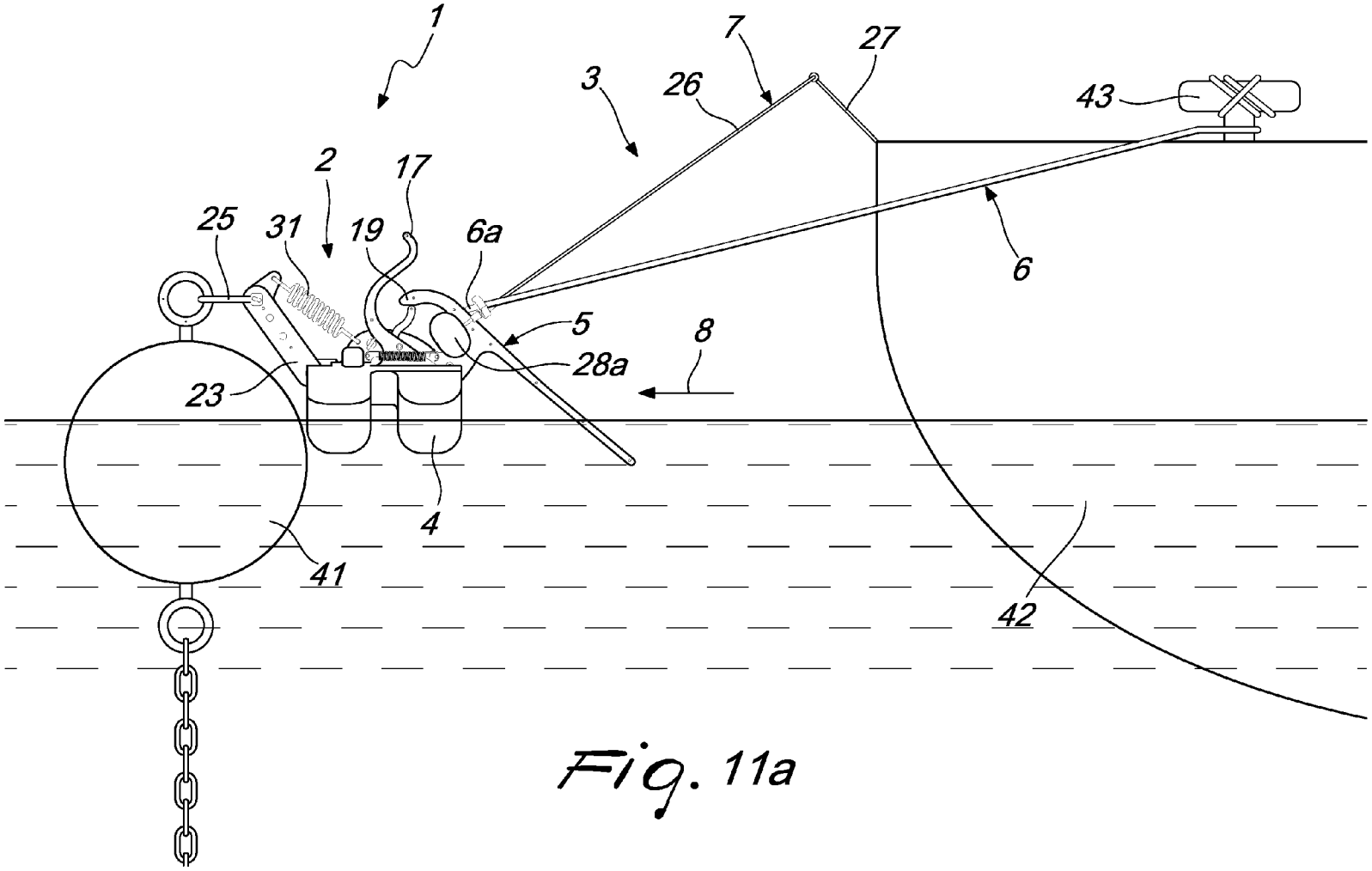
FIG. 11*a* is a lateral elevation view of the same situation of FIG. 11.

The coupling element 2 is secured to the mooring point 40, 41 and is directed with the back 5*a* of the hook element 5, in the coupling position, in the direction from which the vessel to be moored will arrive, as shown in FIGS. 10, 10*a*. It should be noted that the tab 5*c* of the hook element 5 is arranged with its end at the level of the free surface of the water or just below, i.e., in a position in which the impact of the approaching cable portion 6*a* with said tab 5*c* is ensured even in the presence of waves.

Figure 12:
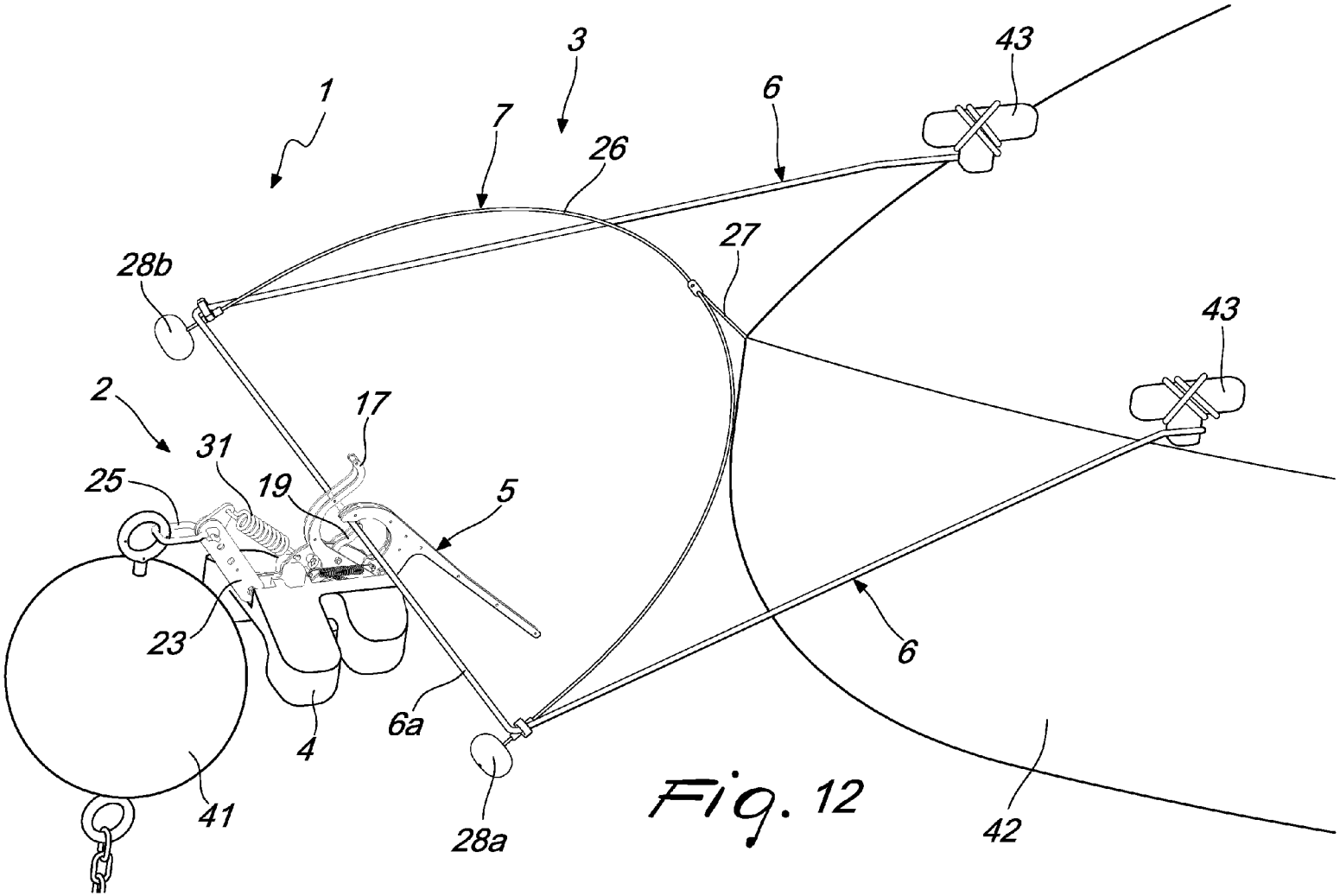
FIG. 12 is a perspective view of the vessel of FIG. 9 during the engagement of the capture element with the coupling element secured to a buoy, with the water omitted for the sake of greater clarity.
Figure 12A:
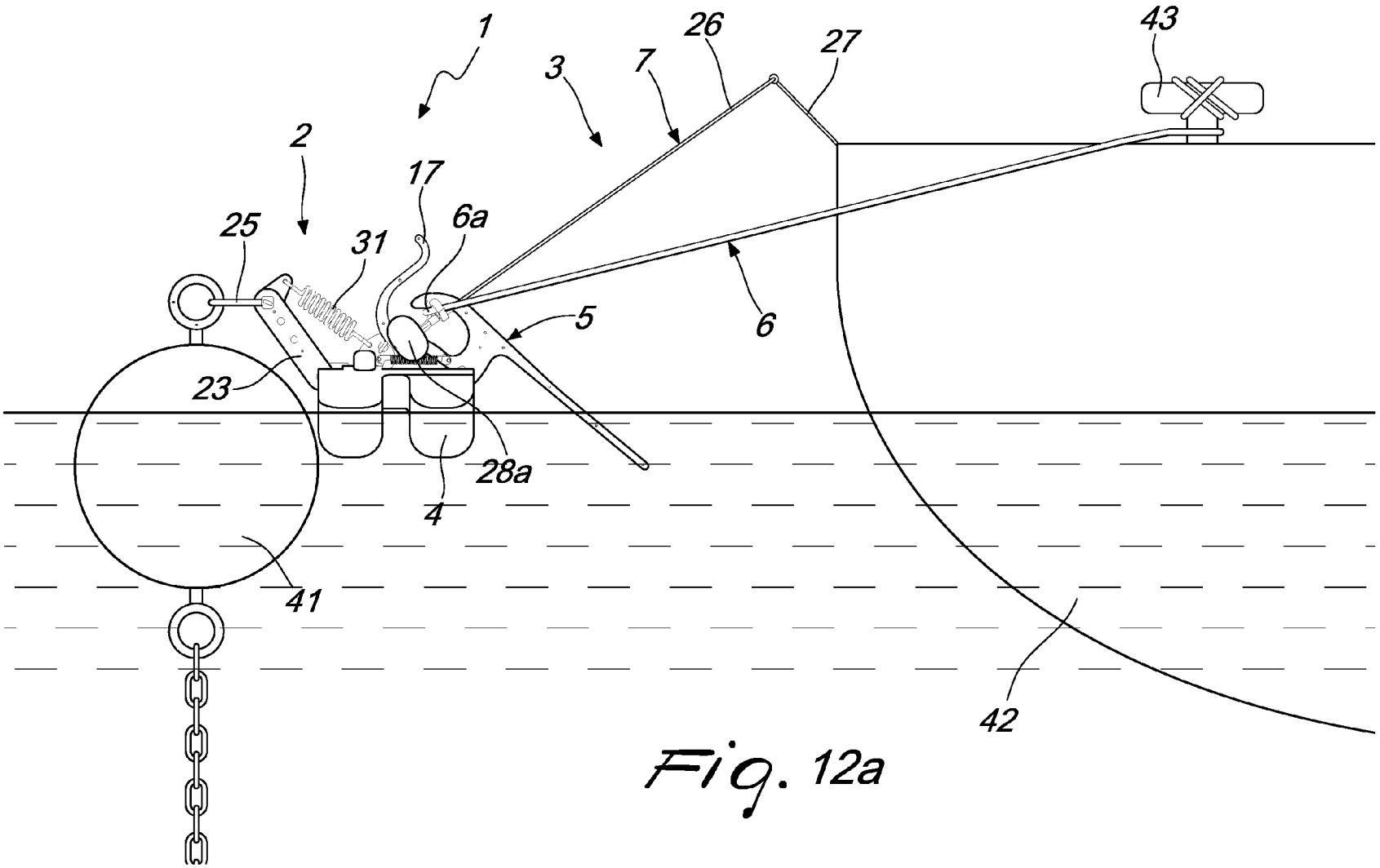
FIG. 12*a* is a lateral elevation view of the same situation of FIG. 12.
Figure 13:
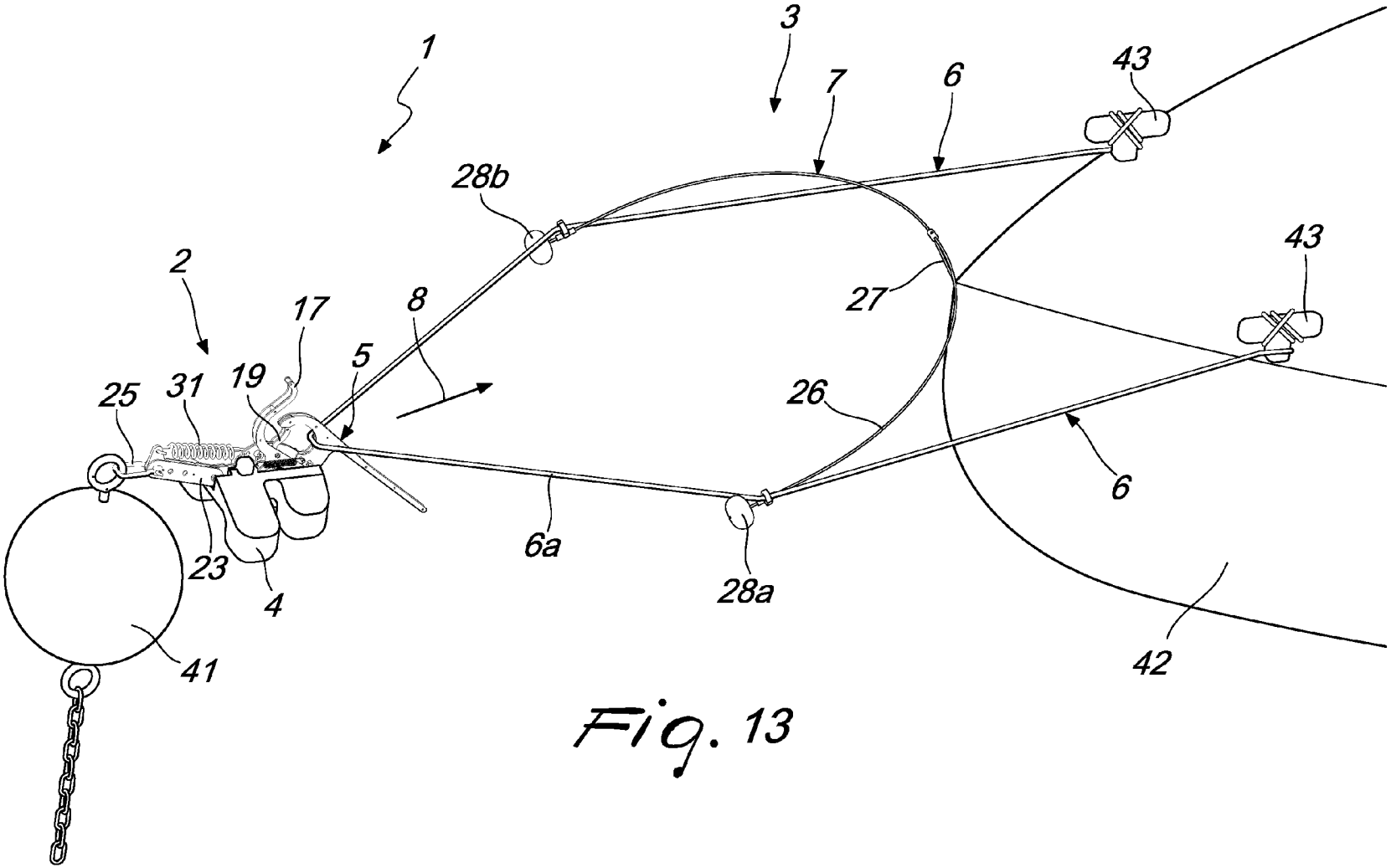
FIG. 13 is a perspective view of the vessel of FIG. 9 with the capture element engaged with the coupling element secured to a buoy, with the water omitted for the sake of greater clarity.
Figure 13A:
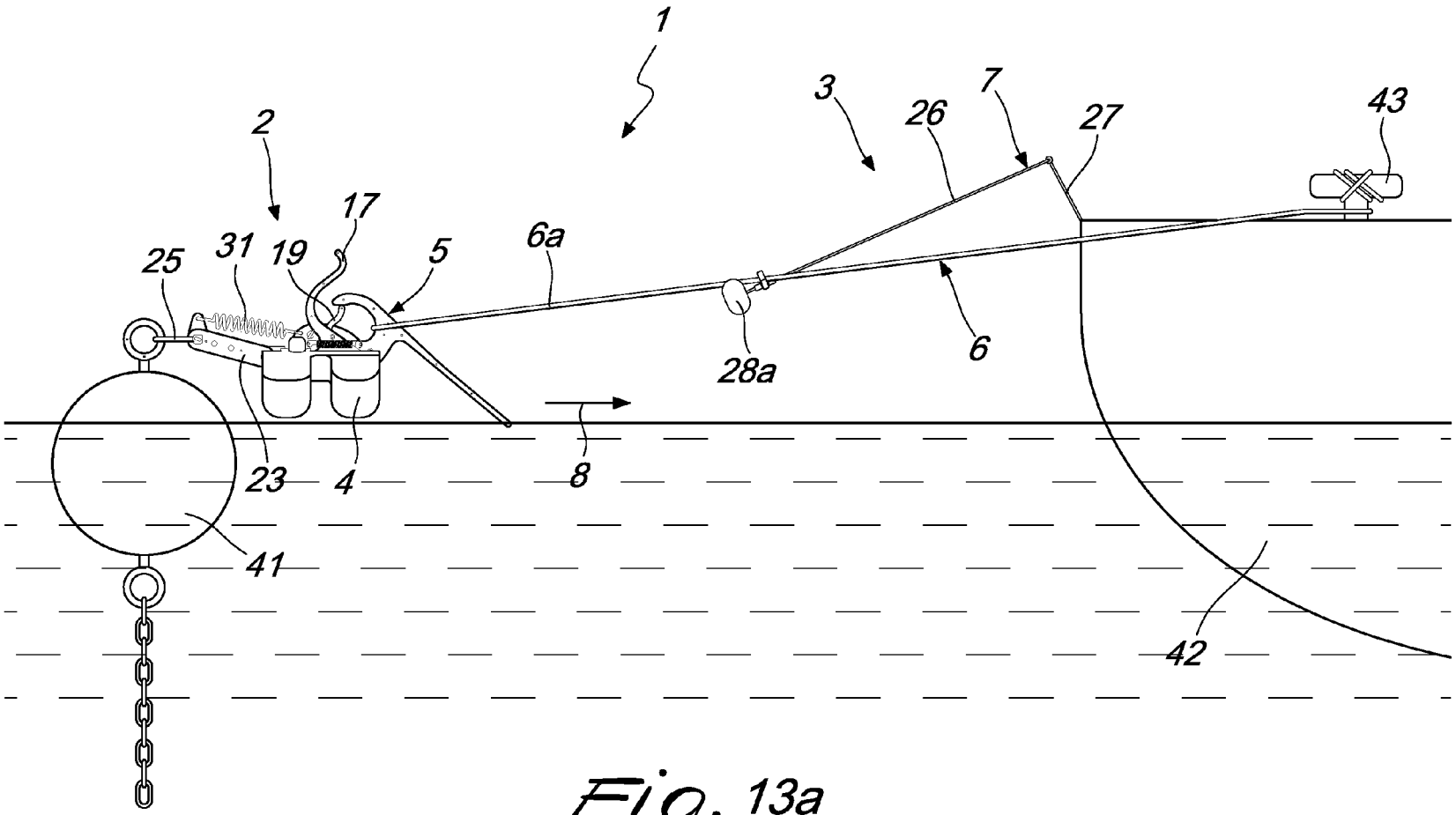
FIG. 13*a* is a lateral elevation view of the same situation of FIG. 13.

During the approach of the vessel 42 to the mooring point 40, 41, the helmsman progressively reduces the speed of the vessel 42 and steers the vessel 42 so that the cable portion 6*a* is arranged transversely to the hook element 5. In this manner, the progressive approach of the vessel 42 to the coupling element 2 causes the engagement of the cable portion 6*a*, tensioned by the elastic bow 26, on the sliding ramp formed by the tab 5*c* up to the tip 5*b* of the hook element 5 (FIGS. 11 and 11*a*) and the subsequent descent into the bend 5*d* of the hook element 5 (FIGS. 12 and 12*a*). It should be noted that the device according to the disclosure allows to obtain the correct engagement of the cable portion 6*a* with the hook element 5 even if the cable portion 6*a* is not perfectly perpendicular to the plane of arrangement of the hook element 5. The transition of the cable portion 6*a* inside the bend 5*d* of the hook element 5 is allowed by the rotation of the safety lever 19, which disengages from the tip 5*b* of the hook element 5 by virtue of the action of the cable portion 6*a* itself, and which reengages the tip 5*b* of the hook element 5, by virtue of the action of the spring that constitutes the third elastic means 20, once the cable portion 6*a* has passed into the bend 5*d* of the hook element 5, safely retaining the cable portion 6*a* inside the bend 5*d* of the hook element 5 and preventing it from accidentally disengaging from the hook element 5, for example due to waves. The helmsman then reverses the direction of motion of the vessel, causing the spacing of the vessel from the mooring point, to which the vessel nonetheless remains secured, since the cable 6 is coupled by the hook element 5 (FIGS. 13 and 13*a*), and the helmsman or other personnel can confidently complete mooring with the traditional mooring cables. It should be noted that since the vessel 42 is secured to the mooring point 40, 41, completion of the mooring operations can be performed even by the helmsman alone, who can abandon the helm.

Figure 14:
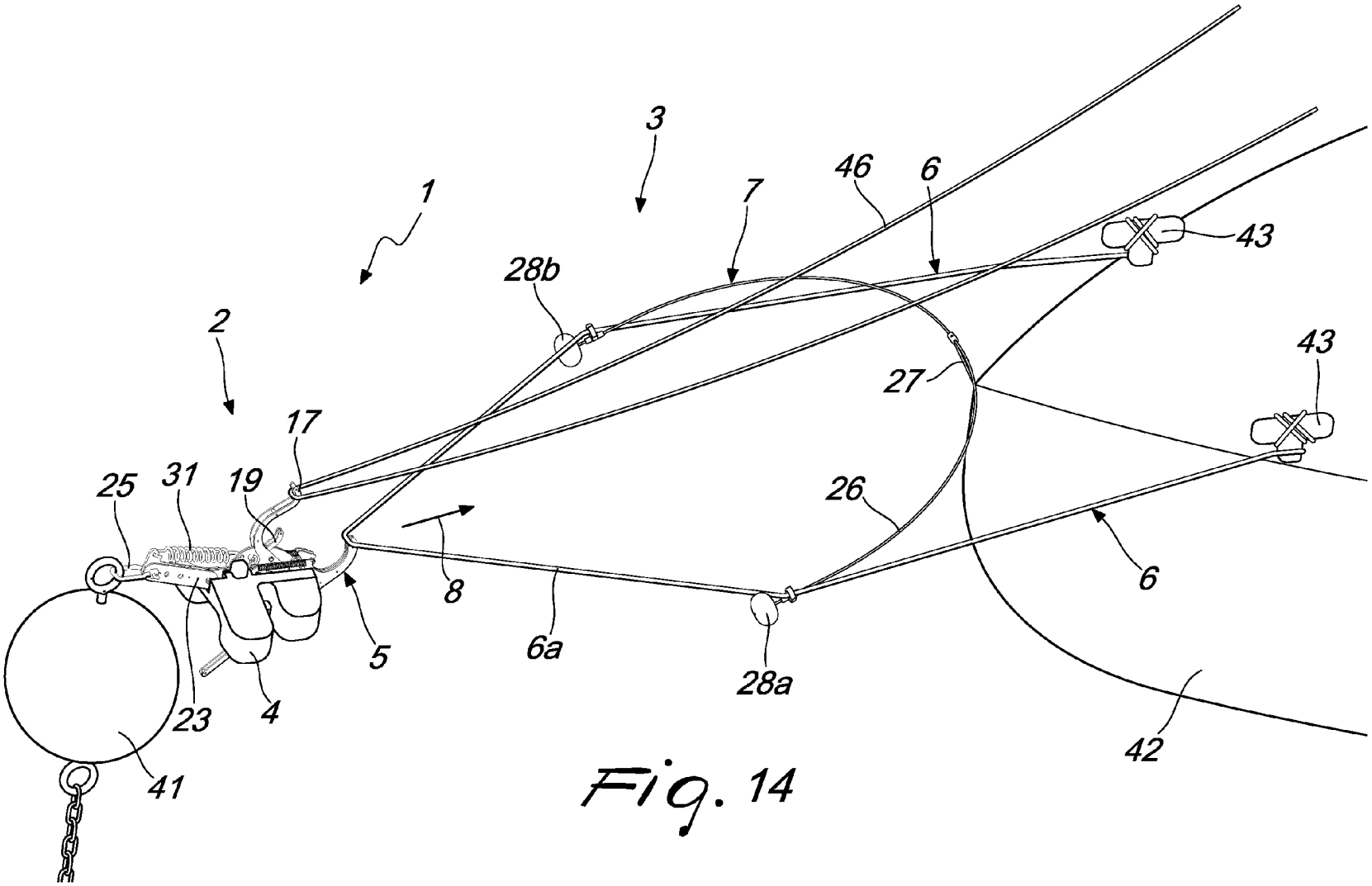
FIG. 14 is a perspective view of the vessel of FIG. 9 during the disengagement of the capture element from the coupling element secured to a buoy, with the water omitted for the sake of greater clarity.
Figure 14A:
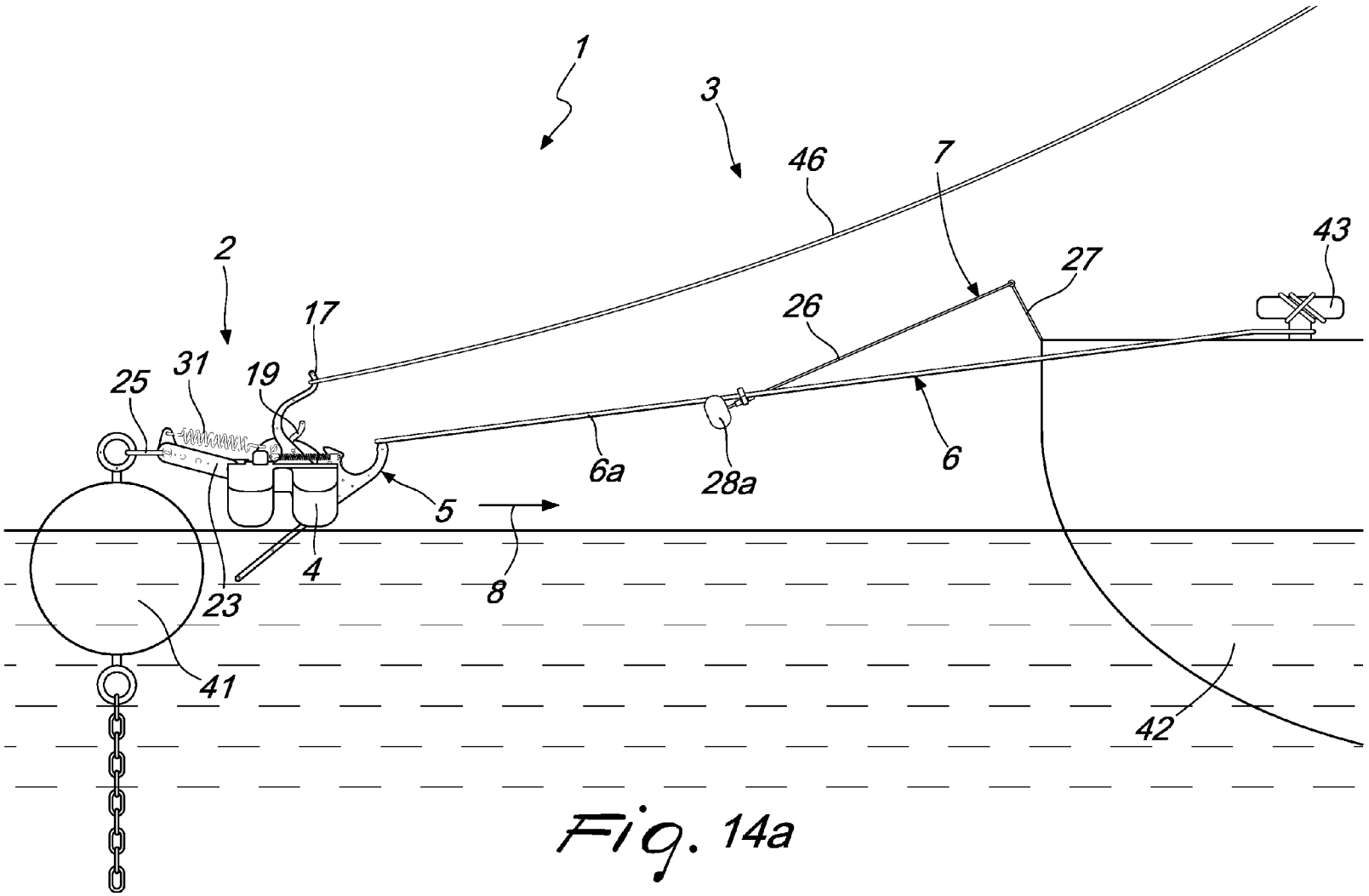
FIG. 14*a* is a lateral elevation view of the same situation of FIG. 14.
Figure 15:
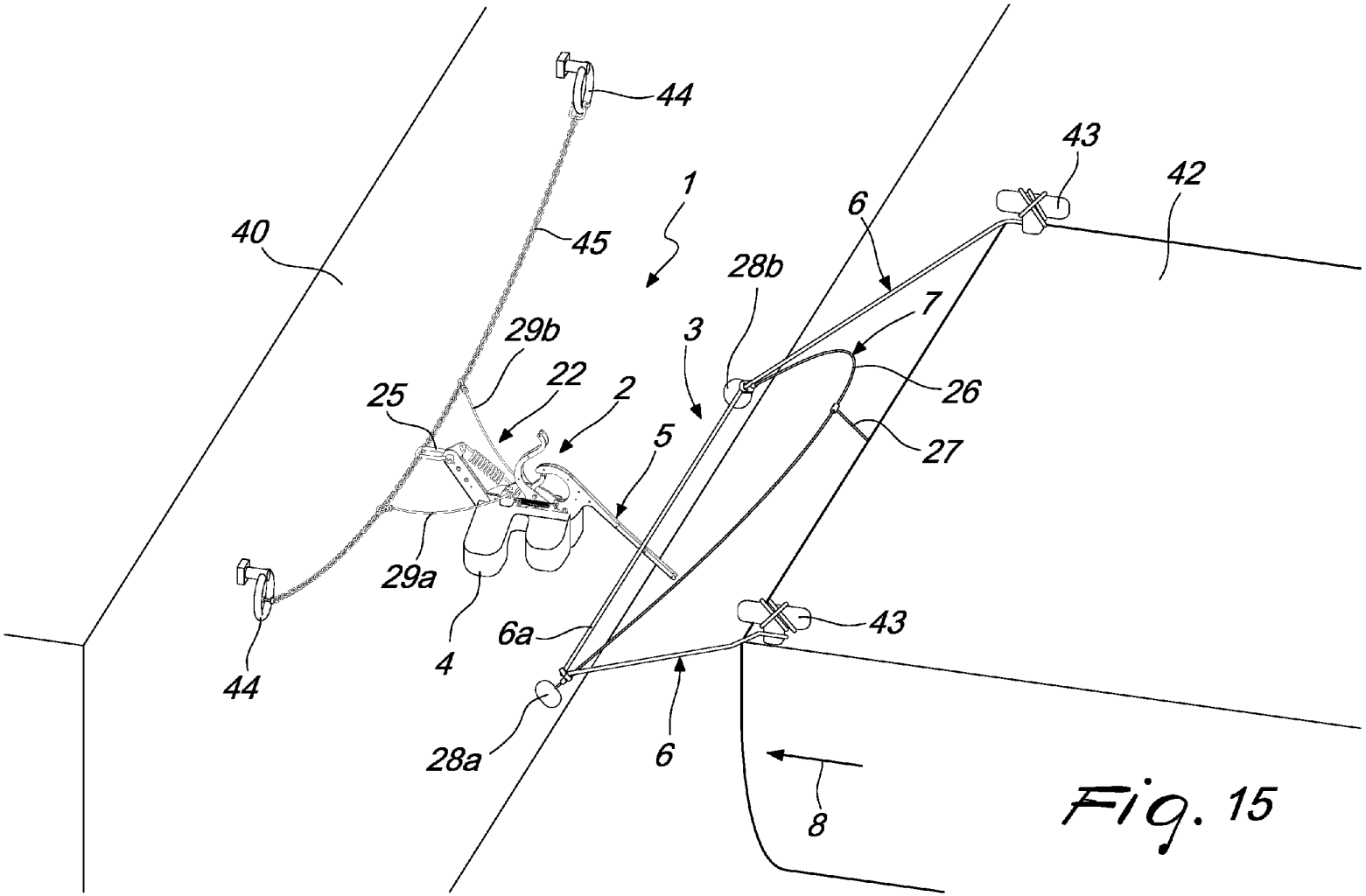
FIG. 15 is a perspective view of the vessel of FIG. 8 during approach to the coupling element secured to a pier or jetty or wharf, with the water omitted for the sake of greater clarity.
Figure 15A:
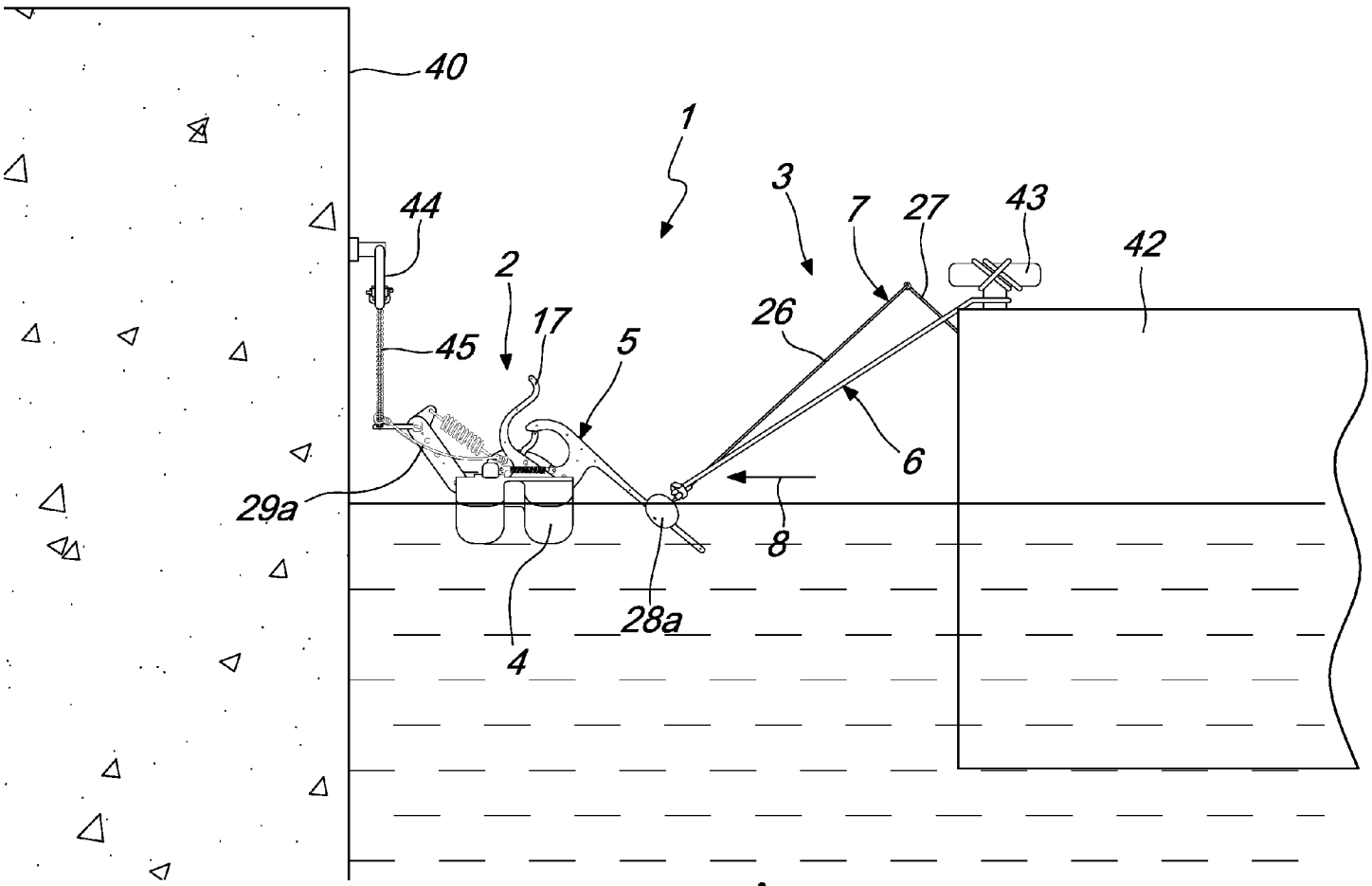
FIG. 15*a* is a lateral elevation view of the same situation of FIG. 15.

The unmooring of the vessel 42 is performed by disengaging beforehand the mooring cables from the mooring point 40, 41 and/or from the vessel 42 and by acting on the locking lever 17 by means of a cable 46 or by means of a boat hook, so as to cause the rotation of the locking lever 17 about the second axis 18 with respect to the supporting element 9 in order to move the locking element 13 from the activated position to the deactivated position, i.e., disengage the finger, which constitutes the locking element 13, from the seat 15 of the hook element 5. The beginning of the spacing of the vessel 42 from the mooring point 40, 41 causes, by means of the cable portion 6*a*, a traction on the hook element 5, which rotates about the first axis 10 with respect to the supporting element 9, disengaging from the safety lever 19 (FIGS. 14 and 14*a*). In this manner, the bend 5*d* of the hook element 5 opens and the cable portion 6*a* disengages from the hook element 5, leaving the vessel 42 free to move away. When the cable portion 6*a* disengages from the hook element 5, said hook element, no longer retained by the cable portion 6*a*, by virtue of the action of the springs 12 is returned to the initial position, i.e., it closes again on the safety lever 19 and is locked in this position by the return of the locking element 13 to the activated position caused by the spring 16 as a consequence of the release of the locking lever 17.

In practice, the hook element 5 is reset automatically after the cable portion 6*a* has disengaged from it.

If the coupling element 2, instead of being secured to the mooring point 40, 41, is secured to the vessel 42 and the capture element 3 is secured to the mooring point 40, 41, the use of the device is similar to what has been described, with the difference that the coupling element 2 approaches the cable portion 6*a* instead of vice versa.

If the capture element 3, instead of being constituted by the cable 6 and the elastic bow 26, is constituted by a bar, the operation of the device according to the disclosure is similar to what has been described above, with the difference that the functions performed by the cable portion 6*a* are performed by the bar.

It should be noted that the arrangement of the hook element 5 on a floating body 4 couples the hook element 5 to the free surface of the water and allows the capture element 3 to engage it even in the presence of sudden and substantial level variations caused by waves and even in the presence of large vertical, horizontal and angular alignment errors. The floating body 4 follows the wave motion freely, but it could also be forced to partially plunge by the engagement with the capture element 3 which follows another wave motion, particularly if the capture element is constituted by a bar, ensuring in any case the engagement of the capture element 3 with the hook element 5.

Furthermore, it should be noted that instead of a single device it is possible to use two devices according to the disclosure, particularly if mooring to a jetty with the stern side of the vessel is intended. By using two devices arranged side by side one achieves the effect of ensuring the perpendicular arrangement of the vessel with respect to the jetty even if there are no lateral resting elements, normally constituted by other moored vessels.

In practice it has been found that the automatic mooring device according to the disclosure fully achieves the intended aim, since it simplifies considerably the mooring operations, reducing the number of workers required, without requiring onerous interventions to adapt the vessels and/or the mooring points. In particular, the device according to the disclosure allows to perform mooring by means of the helmsman alone, who, once he has coupled the vessel by means of the device according to the disclosure, can complete mooring autonomously with the usual cables.

The device thus conceived is susceptible of numerous modifications and variations; thus, for example, the sliding ramp for the capture element 3, formed in the illustrated embodiment by the tab 5*c* of the hook element 5, can is be partly formed by a tab of the floating body 4 and/or by a cover of the floating body 4, which is not shown for the sake of simplicity. All the details may furthermore be replaced with other technically equivalent elements.

In practice, the materials used, as well as the dimensions, may be any according to the requirements and the state of the art.

What is claimed is:

1. An automatic mooring device for vessels, comprising a coupling element, associable with a mooring point or with a vessel, and a capture element, associable with a vessel or with a mooring point and detachably engageable with said coupling element, wherein said coupling element comprises:

an autonomous floating body;

a supporting element fixed to said floating body;

a hook element associated with said supporting element and movable with respect to said supporting element from a coupling position, in which it is adapted to couple and retain in a bend of the hook element said capture element due to a relative motion between said hook element and said capture element along a direction that is substantially parallel to a direction of motion of the vessel, to a release position, in which it is adapted to release said capture element coupled previously and vice versa;

a safety lever, which can engage said hook element so as to close the bend for the retention of said capture element once it has been coupled;

means for retaining said hook element in said coupling position which can be deactivated on command in order to allow a transition of said hook element from said coupling position to said release position which can be deactivated on command.

2. The device according to claim 1, wherein said coupling element is provided with a sliding ramp that is adapted to guide said capture element toward an opening of the bend of said hook element in a motion of relative approach of said capture element to said coupling element.

3. The device according to claim 2, wherein said hook element, during use, is arranged on a substantially vertical plane and can rotate with respect to said supporting element about a first horizontal axis, which is substantially perpendicular to a plane of arrangement of said hook element, in order to pass from said coupling position, in which it is arranged so that a tip of the hook element is directed away from the direction of approach of said capture element to be coupled and so that a back of the hook element is directed toward said capture element during the approach of the vessel to the mooring point, to said release position, in which it is arranged so that the tip is directed upwardly or oppositely with respect to said coupling position in order to release said previously coupled capture element and vice versa.

4. The device according to claim 3, wherein said means for retaining said hook element in said coupling position comprise a locking element that can move from an activated position, in which the locking element prevents the rotation of said hook element, in said coupling position, with respect to said supporting element about said first horizontal axis, to a deactivated position, in which the locking element allows the rotation of said hook element about said first horizontal axis with respect to said supporting element for the transition of said hook element from said coupling position to said release position, said locking element being movable on command from said activated position to said deactivated position in contrast with an action of second elastic means.

5. The device according to claim 4, wherein said locking element is associated with said supporting element and can engage or disengage with respect to said hook element, said locking element being connected to a locking lever which is pivoted to said supporting element and can be actuated for the transition of said locking element from said activated position to said deactivated position in contrast with the action of said second elastic means.

6. The device according to claim 5, wherein said locking lever is pivoted to said supporting element with an intermediate portion about a corresponding second axis that is parallel to said first horizontal axis, said locking lever being connected, by means of one of first and second ends of said locking lever, to said locking element, the opposite end of said locking lever being engageable to cause the rotation of said locking lever with respect to said supporting element about said second axis for the transition of said locking element from said activated position to said deactivated position in contrast with the action of said second elastic means.

7. The device according to claim 3, comprising means for orienting said hook element which are adapted to keep the back of said hook element, in said coupling position, oriented toward said capture element during the approach of the vessel to the mooring point.

8. The device according to claim 3, wherein said sliding ramp is formed by a tab of said hook element that extends the back oppositely with respect to the tip.

9. The device according to claim 3, wherein said safety lever can be disengaged from the tip of said hook element by virtue of the transition of said capture element from the back of the hook element within the bend of the hook element in contrast with an action of third elastic means.

10. The device according to claim 9, wherein said safety lever is pivoted to said supporting element about a corresponding third axis that is parallel to said first horizontal axis and can rotate with respect to said supporting element about said third axis in order to pass from a closed position, in which the safety lever engages the tip of the hook element, to an open position, in which the safety lever is disengaged from the tip of the hook element, in contrast with the action of said third elastic means.

11. The device according to claim 1, wherein said hook element can move from said coupling position to said release position by virtue of the action of said capture element in contrast with an action of first elastic means.

12. The device according to claim 1, wherein said supporting element is provided with an anchoring lever, which can be associated with the mooring point or with the vessel, said anchoring lever being pivoted to said supporting element about a corresponding fourth axis that is parallel to said first horizontal axis and being able to rotate with respect to said supporting element about said fourth axis.

13. The device according to claim 12, wherein said anchoring lever can rotate with respect to said supporting element about said fourth axis in contrast with, or by virtue of an action of, fourth elastic means.

14. The device according to claim 1, wherein said capture element comprises a cable and means for tensioning a portion of said cable transversely to a direction of motion of the vessel to be moored, said cable portion being engageable with said hook element by virtue of a relative motion between said hook element and said cable portion along a direction that is substantially parallel to said direction of motion of the vessel.

15. The device according to claim 14, wherein said means for tensioning said cable portion comprise an elastic bow, which can be coupled to the vessel or to the mooring point and can be engaged with the ends of said cable portion.

16. The device according to claim 14, wherein said means for tensioning said cable portion are provided with floats in order to maintain said cable portion at a preset height level with respect to the free surface of the water correlated to the height level with respect to the free surface of the water of a tab of the hook element.

17. The device according to claim 14, wherein said cable can be fixed, by means of the end portions, externally to said cable portion, to the vessel or to the mooring point.

18. An automatic mooring device for vessels, comprising a coupling element, associable with a mooring point or with a vessel, and a capture element, associable with a vessel or with a mooring point and detachably engageable with said coupling element, wherein said coupling element comprises:

an autonomous floating body;

a supporting element fixed to said floating body;

a hook element associated with said supporting element and movable with respect to said supporting element from a coupling position, in which it is adapted to couple and retain in a bend of the hook element said capture element due to a relative motion between said hook element and said capture element along a direction that is substantially parallel to a direction of motion of the vessel, to a release position, in which it is adapted to release said capture element coupled previously and vice versa;

a safety lever, which can engage said hook element so as to close the bend for the retention of said capture element once it has been coupled;

means for retaining said hook element in said coupling position which can be deactivated on command in order to allow a transition of said hook element from said coupling position to said release position, wherein said supporting element is provided with an anchoring lever, which can be associated with the mooring point or with the vessel, said anchoring lever being pivoted to said supporting element about a corresponding fourth axis that is parallel to said first axis and being able to rotate with respect to said supporting element about said fourth axis, and wherein said anchoring lever can rotate with respect to said supporting element about said fourth axis in contrast with, or by virtue of an action of, fourth elastic means.

19. An automatic mooring device for vessels, comprising a coupling element, associable with a mooring point or with a vessel, and a capture element, associable with a vessel or with a mooring point and detachably engageable with said coupling element, wherein said coupling element comprises:

an autonomous floating body;

a supporting element fixed to said floating body;

a hook element associated with said supporting element and movable with respect to said supporting element from a coupling position, in which it is adapted to couple and retain in a bend of the hook element said capture element due to a relative motion between said hook element and said capture element along a direction that is substantially parallel to a direction of motion of the vessel, to a release position, in which it is adapted to release said capture element coupled previously and vice versa;

a safety lever, which can engage said hook element so as to close the bend for the retention of said capture element once it has been coupled;

means for retaining said hook element in said coupling position which can be deactivated on command in order to allow a transition of said hook element from said coupling position to said release position, wherein said capture element comprises a cable and means for tensioning a portion of said cable transversely to a direction of motion of the vessel to be moored, said cable portion being engageable with said hook element by virtue of a relative motion between said hook element and said cable portion along a direction that is substantially parallel to said direction of motion of the vessel, and wherein said means for tensioning said cable portion comprise an elastic bow, which can be coupled to the vessel or to the mooring point and can be engaged with the ends of said cable portion.

* * * * *